US007401665B2

(12) United States Patent
Guerrero et al.

(10) Patent No.: US 7,401,665 B2
(45) Date of Patent: Jul. 22, 2008

(54) APPARATUS AND METHOD FOR DRILLING A BRANCH BOREHOLE FROM AN OIL WELL

(75) Inventors: Julio C. Guerrero, Cambridge, MA (US); Demos Pafitis, Cambridge, MA (US); Alex Arzoumanidis, Boston, MA (US)

(73) Assignee: Schlumberger Technology Corporation, Ridgefield, CT (US)

( * ) Notice: Subject to any disclaimer, the term of this patent is extended or adjusted under 35 U.S.C. 154(b) by 270 days.

(21) Appl. No.: 10/931,332

(22) Filed: Sep. 1, 2004

(65) Prior Publication Data

US 2006/0042835 A1 Mar. 2, 2006

(51) Int. Cl.
*E21B 23/00* (2006.01)

(52) U.S. Cl. ..... 175/61; 175/99; 166/50

(58) Field of Classification Search ..... 175/26, 175/61, 95, 99; 166/50
See application file for complete search history.

(56) References Cited

U.S. PATENT DOCUMENTS

| | | | | |
|---|---|---|---|---|
| 4,431,068 | A | 2/1984 | Dellinger et al. | 175/61 |
| 4,463,814 | A * | 8/1984 | Horstmeyer et al. | 175/45 |
| 5,213,168 | A | 5/1993 | Warren et al. | 175/61 |
| 5,727,641 | A | 3/1998 | Eddison et al. | 175/76 |
| 5,941,323 | A | 8/1999 | Warren | 175/74 |
| 6,047,784 | A | 4/2000 | Dorel | 175/61 |
| 6,186,233 | B1 | 2/2001 | Brunet | 166/298 |
| 6,189,629 | B1 | 2/2001 | McLeod et al. | 175/67 |
| 6,244,339 | B1 | 6/2001 | Buytaert | 166/255.2 |
| 6,318,480 | B1 | 11/2001 | Hearn | 175/61 |
| 6,325,164 | B1 | 12/2001 | Bayer | 175/61 |
| 6,347,675 | B1 | 2/2002 | Kollé | 175/69 |
| 6,364,034 | B1 | 4/2002 | Schoeffler | 175/38 |
| 6,470,974 | B1 | 8/2002 | Schick | 166/313 |
| 6,427,777 | B1 | 10/2002 | Moore et al. | 175/45 |
| 6,629,570 | B1 * | 10/2003 | Head | 175/61 |
| 2002/0007970 | A1 | 1/2002 | Terry et al. | 175/92 |
| 2003/0127251 | A1 * | 7/2003 | Mazorow | 175/62 |

(Continued)

FOREIGN PATENT DOCUMENTS

| | | |
|---|---|---|
| EP | 0 701 045 B1 | 8/1995 |

(Continued)

*Primary Examiner*—William P Neuder
(74) *Attorney, Agent, or Firm*—James McAleenan, Esq.; Vincent Loccisano, Esq.; Jody DeStefanis, Esq.

(57) ABSTRACT

A wireline drill train is used to drill an elongated, small diameter, lateral branch borehole from near the base of a main well. The drill train, includes a drill module, a first self-propelled thrust module coupled to the drill module, and a second self-propelled thrust module pivotally coupled to the first self-propelled thrust module. Each thrust module includes at least two extendible thrusters. Each extendible thruster includes a six-bar mechanism and a traction tread. The drill train further includes a first articulated linkage linking the first self-propelled thrust module to the drill module, and a second articulated linkage linking the second thrust module to the first thrust module. The second articulated linkage includes a thrust-transmission bar and three retractable stiffener bars. The method for drilling the curved transition region of the lateral branch borehole includes executing a series of alternating pivotal drilling steps and forward drilling steps to create a step-cut region of branch borehole having very small radius of curvature.

23 Claims, 29 Drawing Sheets

U.S. PATENT DOCUMENTS

| | | | | |
|---|---|---|---|---|
| 2003/0196819 | A1 | 10/2003 | Coon | 166/382 |
| 2003/0213599 | A1 | 11/2003 | Tinker | 166/380 |
| 2006/0108151 | A1 * | 5/2006 | Moore et al. | 175/99 |

FOREIGN PATENT DOCUMENTS

| | | | |
|---|---|---|---|
| EP | 0 816 627 | B1 | 7/1997 |
| EP | 1559864 | * | 8/2005 |
| GB | 2 284 624 | | 6/1995 |
| GB | 2 303 881 | | 5/1997 |
| GB | 2 338 735 | | 12/1999 |
| GB | 2373520 | A | 3/2001 |
| GB | 2375362 | A | 5/2001 |
| GB | 2 395 505 | | 5/2004 |
| GB | 2418946 | A | 4/2006 |
| WO | WO 97/08418 | | 6/1997 |
| WO | WO 01/86111 | B1 | 4/2001 |
| WO | WO 03/071084 | A2 | 7/2003 |
| WO | WO 03/095791 | A1 | 11/2003 |

* cited by examiner

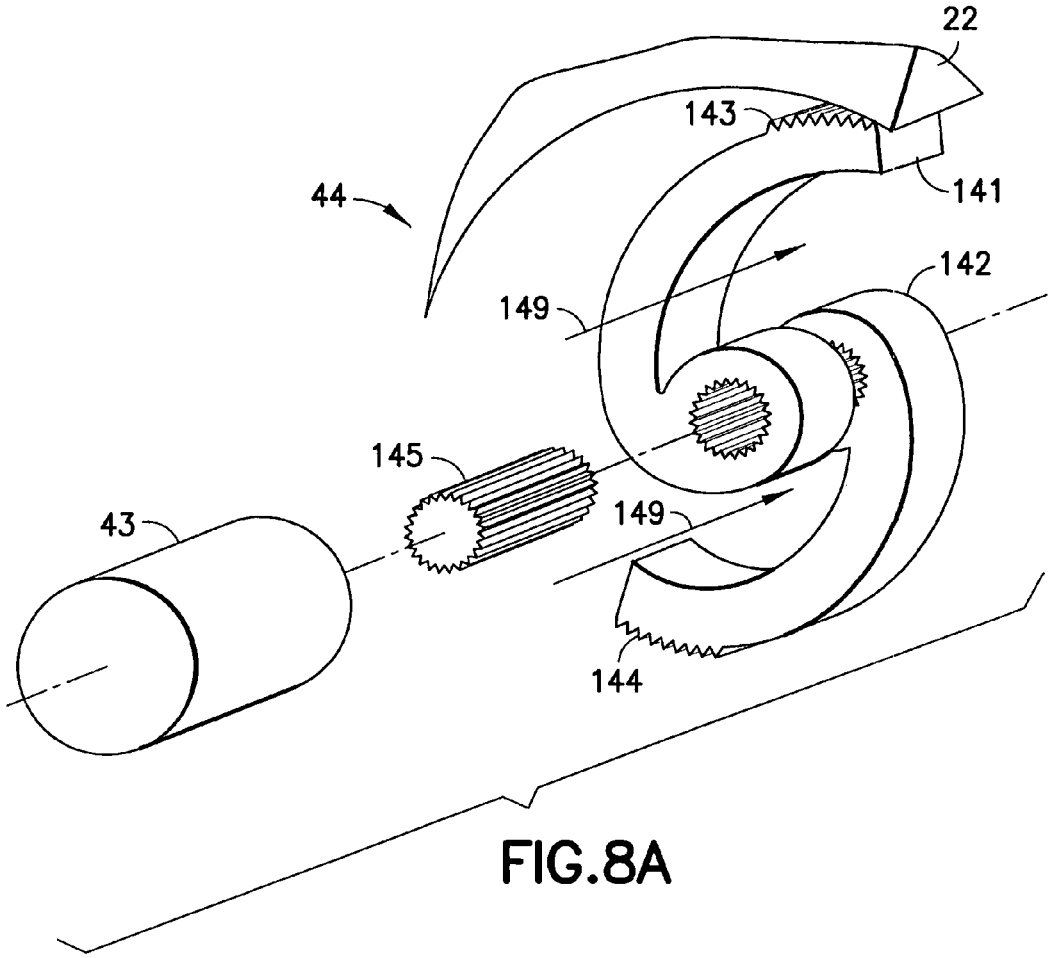
FIG.8A
FIG.8B
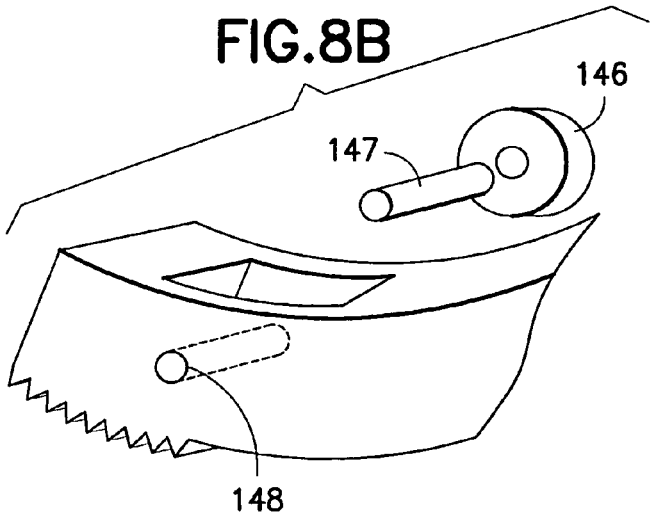

APPARATUS AND METHOD FOR DRILLING A BRANCH BOREHOLE FROM AN OIL WELL

TECHNICAL FIELD

This invention relates generally to drilling systems for oil wells.

BACKGROUND OF THE INVENTION

The oil well drilling industry lacks a system for drilling an elongated, small diameter, lateral branch borehole at a selected depth from a main well, where the lateral branch borehole extends a significant distance from the main well, and the transition from main well to branch borehole has a very small radius of curvature. For a typical main well having an internal diameter of approximately 15 cm, a suitable system would drill a branch borehole having a curved transition portion with radius of curvature less than 5 meters, and would then drill a lateral branch borehole, having a diameter of approximately 60 mm, for a distance of approximately 100 meters. Currently available systems for drilling lateral branch boreholes at a selected depth from a main well do not provide this combination of capabilities. A system having this combination of capabilities would be very valuable.

SUMMARY OF THE INVENTION

The invention provides an apparatus and method, including an articulated modular drill train, for drilling through the wall of an oil well and into earth formation to make a branch borehole at a selected depth.

The drill train, in a first preferred embodiment, includes a drill module, a first self-propelled thrust module coupled to the drill module, and a second self-propelled thrust module pivotally coupled to the first self-propelled thrust module. Each thrust module includes at least two extendible thrusters.

The drill train further includes a first articulated linkage linking the first self-propelled thrust module to the drill module, and a second articulated linkage linking the second thrust module to the first thrust module. The second articulated linkage includes a thrust-transmission bar having the ball of a knuckle joint at each end, and at least three retractable stiffener bars.

Preferably, each thrust module includes two radially opposed extendible thrusters. Alternatively, each thrust module includes three radially-arrayed extendible thrusters.

Preferably, each extendible thruster includes a six-bar mechanism and a traction tread. Alternatively, each thrust module is of the inch-worm type.

The drilling module and the thrust modules each define a portion of an axial mud-outflow passage. The articulated modular drill train further includes a cuttings removal module pivotally coupled to the second thrust module, and an elongated flexible hose fluid-coupled to the cuttings removal module. The hose is longer than the length of the planned branch borehole. The drilling module also includes at least one electric drive motor and an anti-rotation device having first and second cam-shaped arms.

Each thrust module is electric-powered and is adapted to receive electrical power via an electric power cable from a power supply at the well-head.

The drill train is adapted for attachment to the lower end of a wireline.

The invention also provides a drill module, for use in an articulated modular drill train, including a drill bit having a forward cutting portion covering a front end of the drill module, a pivotal cutting portion covering the sides of the drill module, an anti-rotation device, and an electric drive motor coupled to drive the drill bit.

The invention also provides a self-propelled thrust module, for use in an articulated modular drill train, including at least two extendible thrusters attached to the sides of the thrust module, and at least one electric drive motor. Each extendible thruster includes a six-bar mechanism preferably with associated traction treads.

The invention also provides a mechanical articulated linkage, for use in an articulated modular drill train, the linkage including a thrust-transmission bar having the ball of a knuckle joint at each end, and at least three retractable stiffener bars.

The invention also provides a screw-type cuttings removal module, for use in an articulated modular drill train, including first and second co-axial cylindrical housings, each having a spiral cuttings-removal blade mounted thereon, at least one electric drive motor mounted therein, and an anti-rotation device having first and second cam-shaped arms. The cylindrical housings, the anti-rotation device and the at least one electric drive motor are rigidly coupled to an axial shaft.

The invention also provides, in a first preferred embodiment, a method for drilling through the wall of an oil well and into earth formation to make a branch borehole, using an axially-aligned articulated modular drill train, the drill train having a drill module, a cuttings removal module, a first self-propelled thrust module with at least two extendible thrusters having six-bar mechanisms, and a second self-propelled thrust module with at least two extendible thrusters, the modules coupled by articulated linkages.

The method includes placing a whipstock at a selected depth within the well corresponding to the desired depth of the planned branch borehole, attaching the drill train to a wireline above the well, lowering the drill train down the well to a position just above the whipstock, extending the first and second traction treads into contact with the wall of the oil well, setting tilt in the first thrust module such that the drill module is oriented within the well to execute a first drilling step for cutting through the wall of the well at an acute angle.

The method further includes executing a first series of pivotal drilling steps and forward drilling steps to open a sharply-curved step-cut region of branch borehole, while removing cuttings from the drilling operation via a flexible hose for disposal into the well.

The method further includes executing a second series of forward drilling steps to open an extended lateral region of branch borehole, while removing cuttings from the drilling operation via a flexible hose for disposal into the main well.

The method further includes drilling the branch borehole in a planned azimuthal direction by orienting the articulated modular drill train by conventional means to an azimuthal direction corresponding to the desired azimuthal direction of the planned branch borehole prior to drilling.

The method further includes extending the first and second traction treads by adjusting six-bar mechanisms.

The method further includes setting eccentricity in both thrust modules such that both thrust modules are positioned close to the wall of the oil well on the side of the planned branch borehole prior to setting tilt in the first thrust module, wherein setting tilt includes adjusting the six-bar mechanisms.

BRIEF DESCRIPTION OF THE DRAWINGS

FIG. 8A is an exploded view of the anti-rotation device of the drill module shown in FIG. 1.

FIG. 8B is an exploded view of the wheel portion of the anti-rotation device shown in FIG. 8A.

DETAILED DESCRIPTION OF THE INVENTION

Detailed Description General

The present invention provides an apparatus and method for drilling through the casing of an oil well into earth formation at a selected depth to make a branch borehole. The apparatus includes an articulated modular drill train attached to a wireline. A first preferred embodiment of the apparatus of the invention is illustrated in FIGS. 1-19. A first preferred method of the invention is illustrated in FIGS. 20-29.

Detailed Description, Apparatus of First Preferred Embodiment

The Modules of the Drill Train

Figure 1:
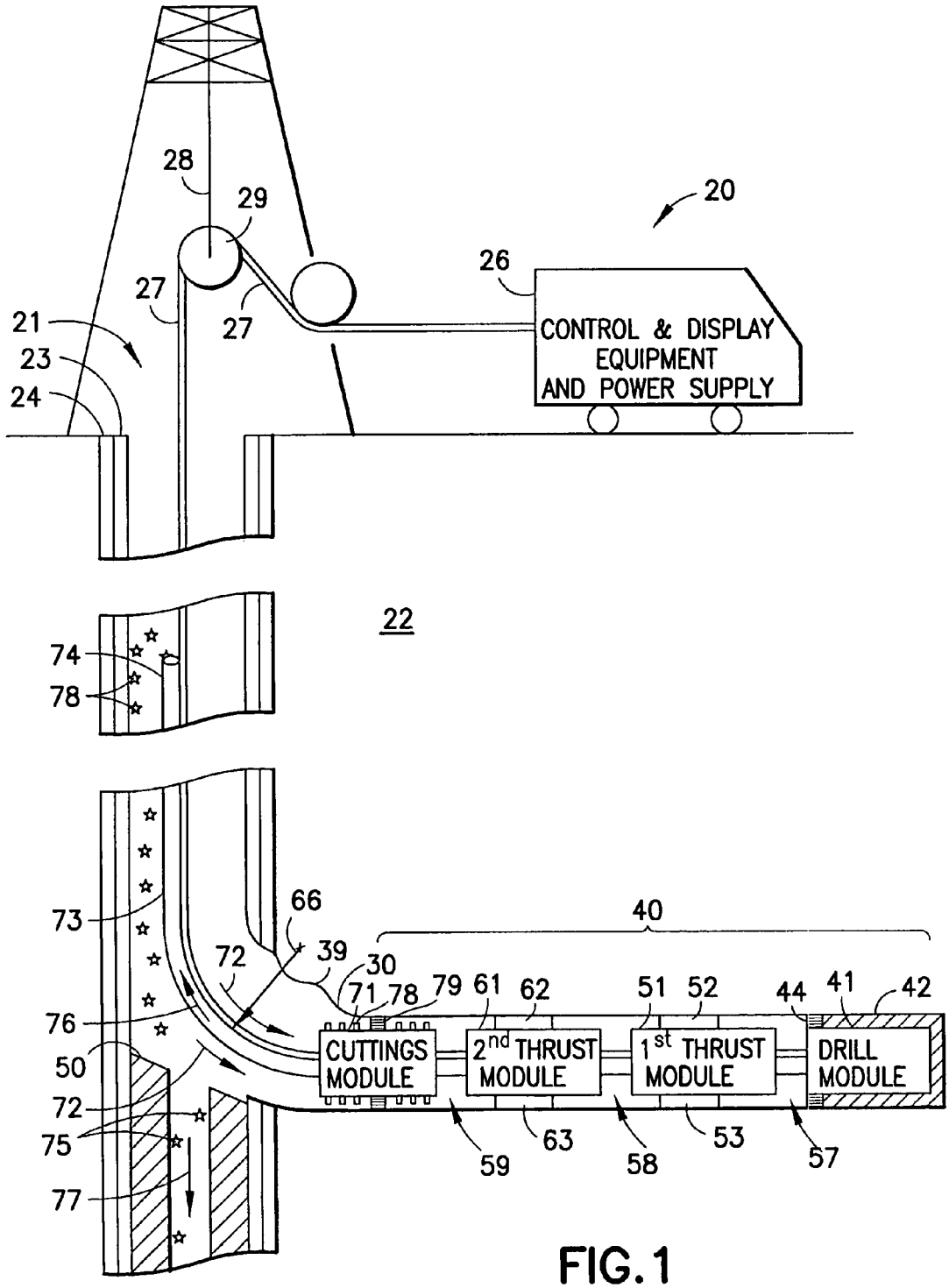
FIG. 1 is a cut-away schematic view of a first preferred embodiment of apparatus for drilling a branch borehole from an oil well according to the invention.

FIG. 1 is a cut-away schematic view of the first preferred embodiment of apparatus for drilling a branch borehole from an oil well according to the invention. FIG. 1 shows branch borehole drilling system 20 located in branch borehole 30 that has been drilled from cased well 21 within earth formation 22. Cased well 21 is a typical main borehole encased by a steel casing 23 having an internal diameter of approximately 15 cm. Casing 23 is backed by cement fill 24. Whipstock 50 is placed in the cased well prior to introducing the drill train. The whipstock defines the depth at which the branch borehole is to be drilled and provides a solid bridge over which the drill train can move into the borehole entry point.

Articulated modular drill train 40 of FIG. 1 is attached to surface equipment 26 by wireline 27. Wireline 27 descends from pulley 29. Pulley 29 is supported by cable 25. Drill train 40 is coupled to receive control signals and power from surface equipment 26 via wireline 27. Surface equipment 26 includes control and display equipment and power supply. Wireline 27 also supports the wireline tools of drill train 40 during their descent down the main well.

Drill train 40 includes drill module 41, first self-propelled thrust module 51, second self-propelled thrust module 61, and cuttings removal module 71. Drill module 41 includes rotary drill bit 42, drill motor 43 (not shown), and anti-rotation device 44. First thrust module 51 includes first traction tread 52 and second traction tread 53. Second thrust module 61 includes third traction tread 62 and fourth traction tread 63. Cuttings removal module 71 includes cuttings-removal blade 78 and anti-rotation device 79.

Drill bit 42 covers the front end of the drill module for forward drilling. Drill bit 42 also covers the sides of the drill module for pivotal drilling. Drill module 41 includes anti-rotation device 44 as indicated in FIG. 1, and an electric drill-drive motor 43 (not shown in FIG. 1). The motor is powered by electrical energy delivered over wireline 27. Mud is driven by cuttings removal module 71 through an axial mud-outflow passage (not shown) in drill bit 42, and through the axial mud-outflow passage of each of the thrust modules, and through each of fluid couplings 57-59 into mud-discharge hose 73. This flow of mud from the region of the drill bit flushes cuttings up flexible mud-discharge hose 73 for discharge at the top 74 of the mud-discharge hose. (See mud outflow with cuttings 76). Cuttings 75 then fall to the bottom of the well for cuttings disposal. (See cuttings disposal 77). FIG. 1 shows first fluid and power coupling 57, second fluid and power coupling 58, and third fluid and power coupling 59. These couplings provide continuation of wireline 27, and flexible mud-discharge hose 73, between the modules of the drill train. The continuation of cable 27 carries electric power and control signals to each of the modules of the drill train. The continuation of hose 73 carries mud with cuttings through the axial conduit within each of the modules of the drill train.

Figure 2:
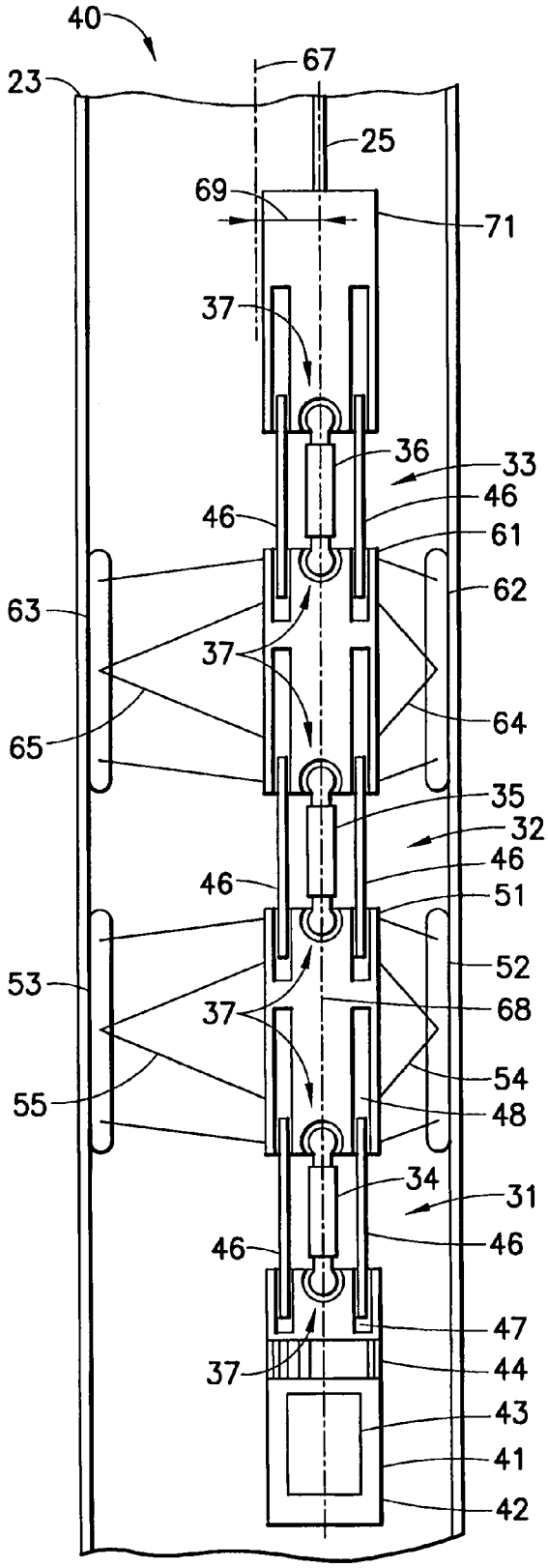
FIG. 2 is a cut-away schematic view of the drill train of the embodiment of FIG. 1.

FIG. 2 is a cut-away schematic view of the drill train of the embodiment of FIG. 1. FIG. 2 shows the first, second and third articulated linkages of the first preferred embodiment. First articulated linkage 31 couples drill module 41 to first thrust module 51. Second articulated linkage 32 couples first thrust module 51 to second thrust module 61. Third articulated linkage 33 couples second thrust module 61 to cuttings removal module 71. Each articulated linkage includes a thrust-transmission bar having the ball of a knuckle joint attached at each end. FIG. 2 shows articulated linkages 31, 32 and 33 having thrust-transmission bars 34, 35 and 36, respectively.

Each thrust module includes two six-bar mechanisms. Each six-bar mechanism supports a traction tread. The pair of six-bar mechanisms associated with a given thrust module is controlled to properly position and orient the thrust module within the cased well before each drilling step. As shown in FIG. 2, first thrust module 51 includes first traction tread 52 attached by first six-bar mechanism 54, and second traction tread 53 attached by second six-bar mechanism 55. Second thrust module 61 includes third traction tread 62 attached by third six-bar mechanism 64, and fourth traction tread 63 attached by fourth six-bar mechanism 65. Each six-bar mechanism is operable to set its thrust module to have a selected eccentricity and a selected tilt angle about the geometric center of the thrust module in relation to the axis of the cased well (or in relation to the axis of the local borehole). By setting the parameters of the two six-bar mechanisms of a given thrust module, the given thrust module may be positioned and oriented to achieve both a selected eccentricity and a selected tilt angle. The selected angle is the angle between the axis of the given thrust module and the axis of the cased well (or the borehole). The eccentricity, $E_{cc}$, of a given thrust module within a cased well is a ratio equal to the distance between the center of the given thrust module and the nearest point on the axis of the cased well divided by the radius of the cased well minus the minimum thickness of one extendible thruster. (Compare FIGS. 3 and 10. Also see FIG. 21, item 69). The eccentricity, $E_{cc}$, of a given thrust module within a borehole is calculated in like manner, except that the local borehole may be curved, as shown in step-cut region 39 of FIG. 1. In FIG. 2, axis 68 of first thrust module 51 is shown spaced apart from and substantially parallel to axis 67 of the cased well. In the example of FIG. 2, eccentricity 70 is non-zero because axis 68 is spaced apart from axis 67. Also the tilt angle is zero because axis 68 and axis 67 are shown as being substantially parallel.

Each articulated linkage also includes a set of three retractable stiffener bars. FIG. 2 shows each of articulated linkages 31, 32 and 33 having a set of three stiffener bars 46. The three stiffener bars of a given set are identical. When the three stiffener bars between two adjacent modules are engaged, they hold the two adjacent modules in a rigid axially-aligned array. The stiffener bars are structural members. Stiffener bar 46 is engaged, as shown in FIG. 2, when inserted in locking aperture 47. Stiffener bar 46 is not engaged when it is retracted into retraction aperture 48. The stiffener bars, when engaged during a drilling step, provide load sharing in addition to holding the two adjacent modules in a rigid axially-aligned array. During drilling of the curved transition from the main well to the branch borehole at small radius of curvature 66 (see FIG. 1), stiffener bars are selectively retracted as a set to allow articulation of the drill train through the transition.

FIG. 1 shows step-cut region 39 of the branch borehole. Region 39 is shaped by drill train 40 driving downward toward whipstock 50 while executing alternating pivotal and forward drilling steps. These alternating drilling steps make step-cut region 39 as a small-radius curved transition from the main well to the planned branch borehole.

The first preferred embodiment of FIGS. 1 and 2 is capable of drilling a small diameter branch borehole, approximately 61 mm (2.4 inch) diameter, with a very small radius of curvature 66, approximately 5 m (13 feet), between the axis of the casing and the axis of the branch borehole, to a distance of approximately 100 m (300 feet) from the oil well.

First self-propelled thrust module 51 is essentially identical to second self-propelled thrust module 61. FIG. 2 shows first thrust module 51 including a first traction tread 52 supported by a first six-bar mechanism 54, and a second traction tread 53 supported by second six-bar mechanism 55. Second thrust module 61 includes third traction tread 62 supported by a third six-bar mechanism 64, and a fourth traction tread 63 supported by fourth six-bar mechanism 65. Each six-bar mechanism is independently operable. In the first preferred embodiment, each thrust module includes two six-bar mechanisms disposed on opposite sides of the thrust module such that they are co-planar.

Figure 3:
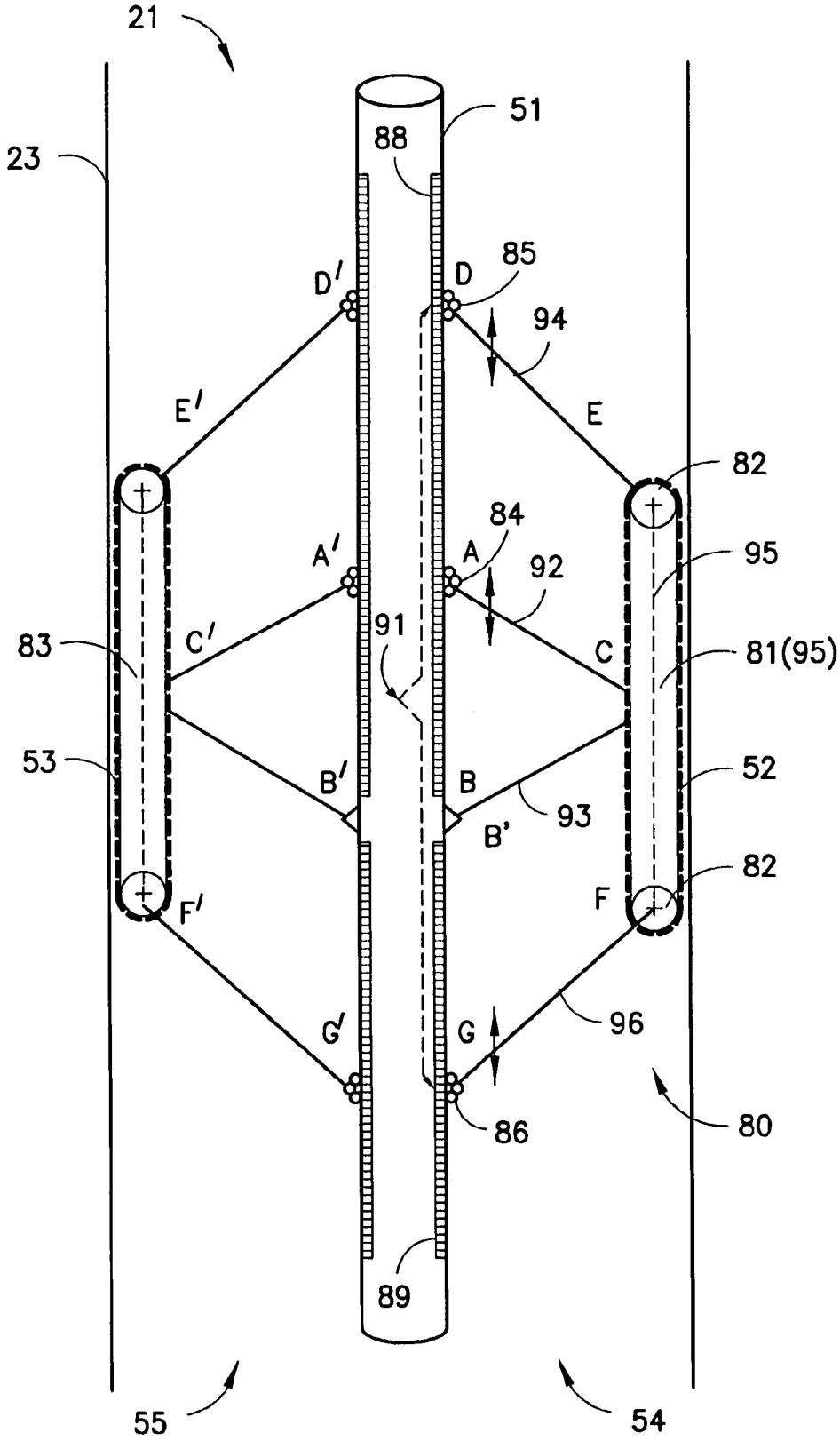
FIG. 3 is a side view of the first thrust module of FIGS. 1 and 2 with axis vertical, as located in the well, illustrating its first and second six-bar mechanisms.

FIG. 3 is a side view of first thrust module 51 located within casing 23 of cased well 21 with axis vertically oriented. It illustrates the first and second six-bar mechanisms of first thrust module 51. FIG. 3 also shows first traction tread 52 and second traction tread 53 of first thrust module 51. First traction tread 52 and second traction tread 53 are shown with both traction treads in contact with steel casing 23. First traction tread 52 is shown supported by its associated six-bar mechanism 54. Second traction tread 53 is shown supported by its associated six-bar mechanism 55. Rigid frame 81 associated with first traction tread 52 supports a pair of track wheels 82. Traction tread 52 is mounted for motion around the two track wheels.

FIG. 3 shows six-bar mechanism 54 having six rigid bars 91-96, coupled by seven joints A, B, C, D, E, F, and G. Bar 91 is attached to module 51 along a first elongated edge of module 51. Bar 95 is preferably formed integral with frame 81.

As noted above, each thrust module preferably includes two six-bar mechanisms. In the first preferred embodiment, each six-bar mechanism supports a traction tread, and each six-bar mechanism and its associated tractor tread with its frame and wheels constitutes an extendible thruster, as indicated by arrow 80 in FIG. 3.

Figure 4:
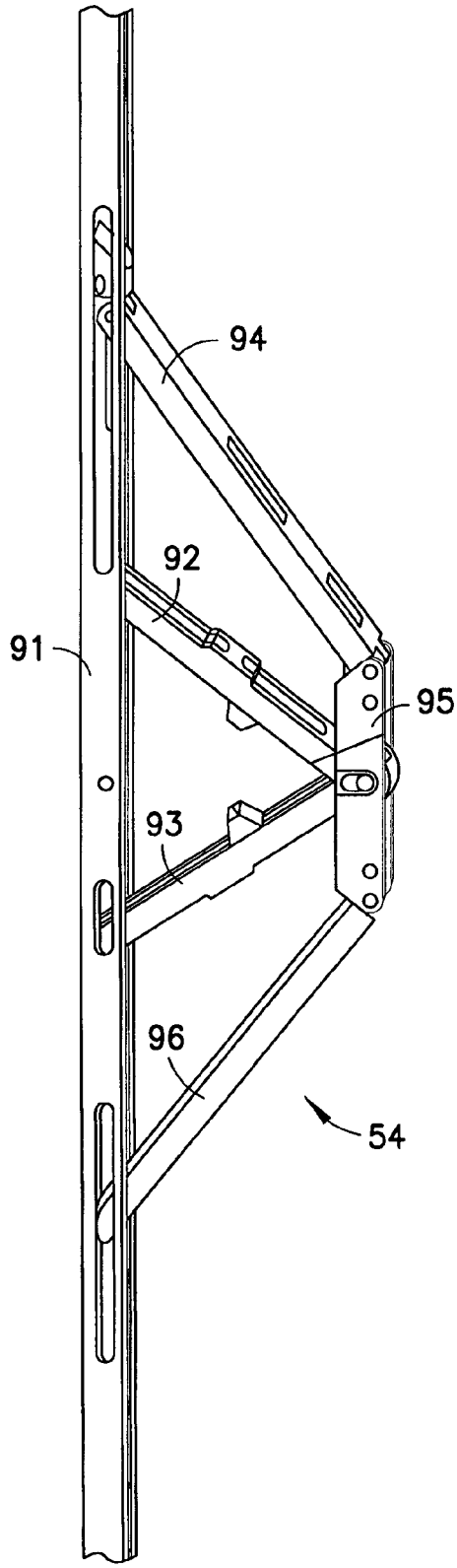
FIG. 4 is a perspective view of the first six-bar mechanism.

FIG. 4 is a perspective view of first six-bar mechanism 54 of first thrust module 51. FIG. 4 illustrates the mechanical structure of bars 91-96 that are shown schematically in FIG. 3.

Second thrust module 61 (shown in FIGS. 1 and 2 but not illustrated in FIGS. 3 or 4) is structurally identical to first thrust module 51. First thrust module 51 includes first traction tread 52 and second traction tread 53. As shown in FIG. 2, second thrust module 61 includes third traction tread 62 and fourth traction tread 63. Second thrust module 61 also includes third six-bar mechanism 64 and fourth six-bar mechanism 65, the third and fourth six-bar mechanisms connecting third and fourth traction treads, respectively, to the second thrust module.

The characteristics of the six-bar mechanisms are further discussed below in more detail with reference to FIGS. 10-19.

FIGS. 5A-5B, 6A-6B, and 7A-7B, show detail of the first, second and third articulated linkages 31-33 of FIG. 2. Linkages 31, 32 and 33 are essentially identical. Each linkage includes a bar terminating at each end in a knuckle joint 37, and a set of three retractable stiffener bars 46. Thrust-transmission bars 34, 35, and 36 with their associated sets of retractable stiffener bars 46 are illustrated in FIG. 2. FIG. 2 also shows six knuckle joints 37, two for each of the three thrust-transmission bars. The several parts of knuckle joint 37 are illustrated in FIGS. 5A through 7B.

Figure 5A:
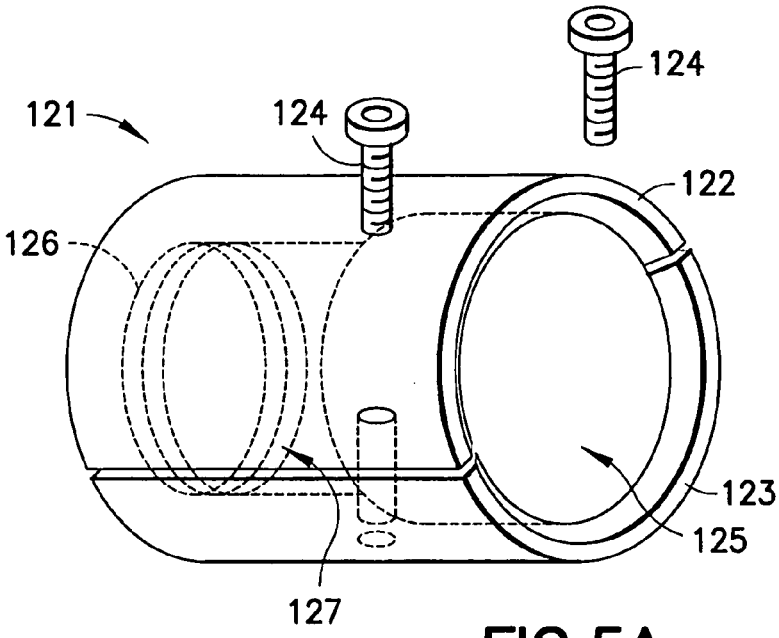
FIG. 5A is an exploded view of the socket of the knuckle joint shown in FIG. 2.
Figure 5B:
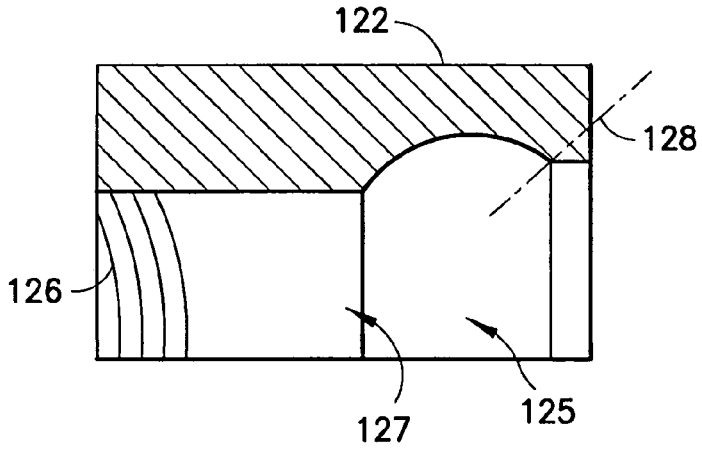
FIG. 5B is a first section view of the socket of FIG. 5A.
Figure 5C:
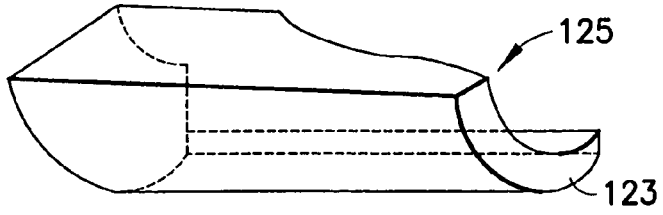
FIG. 5C is a second section view of the socket of FIG. 5A.

FIG. 5A is an exploded view of the socket of the knuckle joint of FIG. 2. FIG. 5A shows socket 121 having first and second socket halves 122 and 123 joint by screw 124 to form socket cavity 125. Socket halves 122 and 123 also define conduit 127. Conduit 127 allows passage of wires that carry power and control signals as well as mud. Conduit 127 also defines female thread 126 by which the knuckle joint is attached to its associated module. Socket 121 is further illustrated in the section drawing of FIG. 5B and the cut-away drawing of FIG. 5C. FIG. 5B shows conical face 128 that limits the maximum pivoting angle of the knuckle-jointed linkage.

Figure 6A:
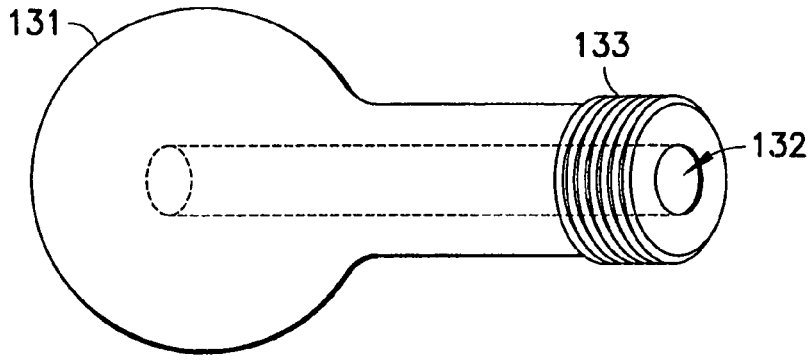
FIG. 6A is a perspective view of the ball joint of the knuckle joint shown in FIG. 2.
Figure 6B:
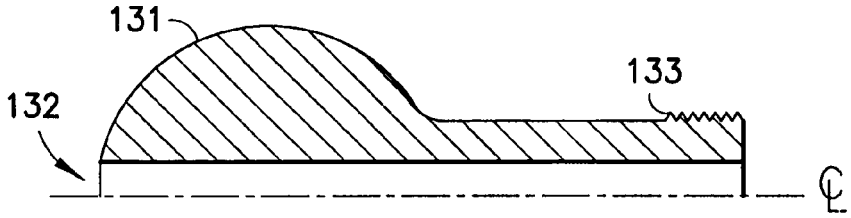
FIG. 6B is a section view of the ball joint of FIG. 6A.
Figure 6C:
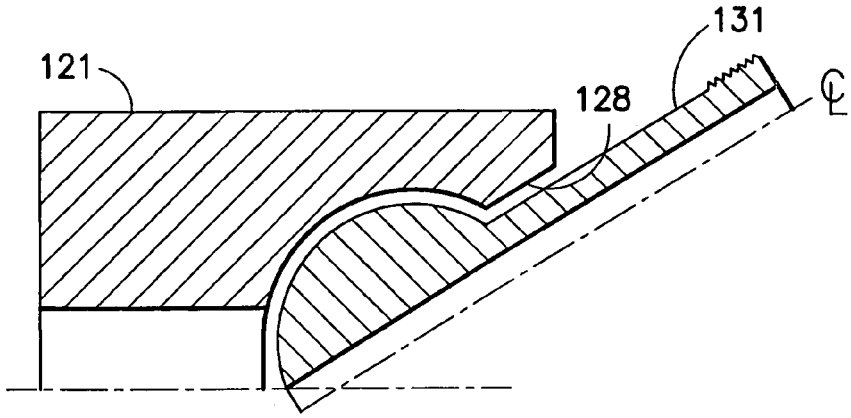
FIG. 6C illustrates the range of motion of the knuckle joint shown in FIG. 2.

FIG. 6A is a perspective view of the ball joint of the knuckle joint shown in FIG. 2. FIG. 6A shows spherical ball joint 131 penetrated by conduit 132. Conduit 132 allows passage of wires that carry power and control signals as well as mud. Ball joint 131 also defines male thread 133 by which the ball joint is attached to its associated rigid bar (Shown in FIG. 2 as 34, 35 or 36. Not shown in FIGS. 6A-6C). FIG. 6B shows ball joint 131 in cross section. FIG. 6C illustrates the range of motion of the knuckle joint of FIG. 2, showing the knuckle joint at one end of its pivoted range.

Figure 7A:
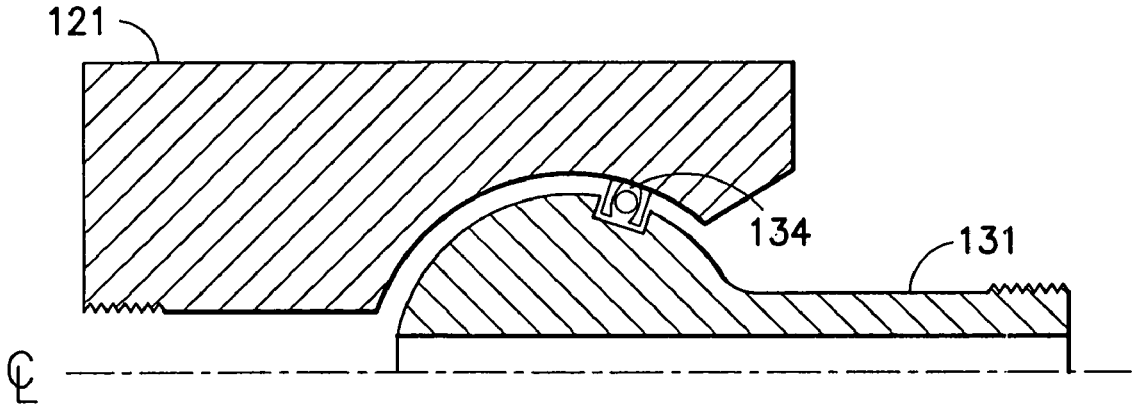
FIG. 7A is a section view of the knuckle joint shown in FIG. 2 indicating the seal.
Figure 7B:
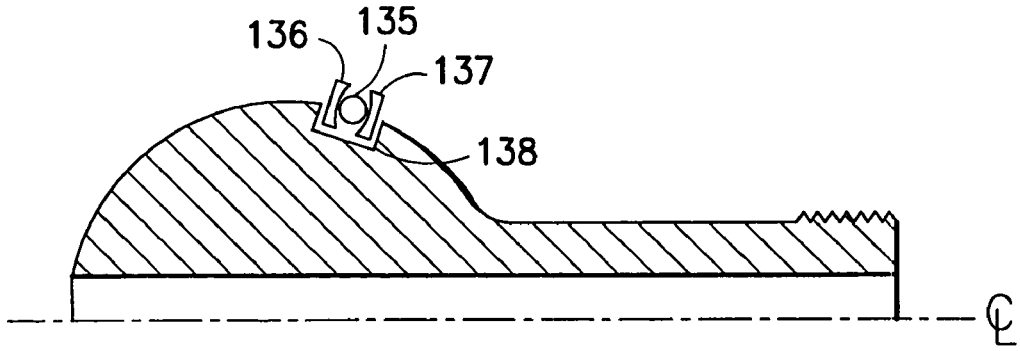
FIG. 7B shows detail of the seal of FIG. 7A.

FIGS. 7A and 7B show the sealing arrangement of the knuckle joint of FIG. 2. The sealing arrangement includes seal 134 comprising O-ring 135 and backup rings 136 and 137, all set in seal seat 138. This seal is provided to protect the knuckle joints from cuttings in the surrounding fluid. (Mud outflow with cuttings passes through the modules but around the bars and their knuckle joints).

FIG. 8A is an exploded view of anti-rotation device 44 of drilling module 41 shown in FIG. 1. FIG. 8A shows anti-rotation device 44 having first and second curved, self-tightening cam-shaped arms 141 and 142. Each of arms 141 and 142 carries teeth, teeth 143 and 144 respectively, on its outer end. The arms are coupled to the frame of electric drill-drive motor 43 (not shown) by splined axial shaft 145. The teeth prevent rotation of the drill module by gripping on formation 22 surrounding the branch borehole when the arms are fully extended. The teeth have angle of attack greater than or equal to 90°. The spaces indicated by arrows 149 between the arms allow cuttings to flow axially between them. FIG. 8B shows anti-rotation device 44 having a wheel portion. To facilitate axial translation along a borehole, each arm includes a translation wheel 146 and an eccentric shaft 147, the shaft fitting within shaft seat 148.

Cuttings removal module 71 is shown in FIG. 1 receiving control signals and power via wireline 27. FIG. 1 also shows module 71 surrounded by mud inflow, flowing as indicated by the two arrows 72. As shown in FIG. 1, cuttings removal module 71 is coupled to receive cuttings-contaminated mud discharge from via the central conduit (not shown) of second thrust module 61. The cutting removal module pumps this mud up flexible mud-discharge hose 73. Mud outflow (see arrow 76), with cuttings is discharged at the top 74 of flexible hose 73, to allow cuttings 75 to fall to the bottom of cased well 21 to achieve cuttings disposal (see arrow 77).

Cuttings removal module 71 (a pump) is shown in FIG. 2 connected to wireline 27 at its upper end and connected to second self-propelled thrust module 61 via third articulated linkage 33 at its lower end.

Figure 9:
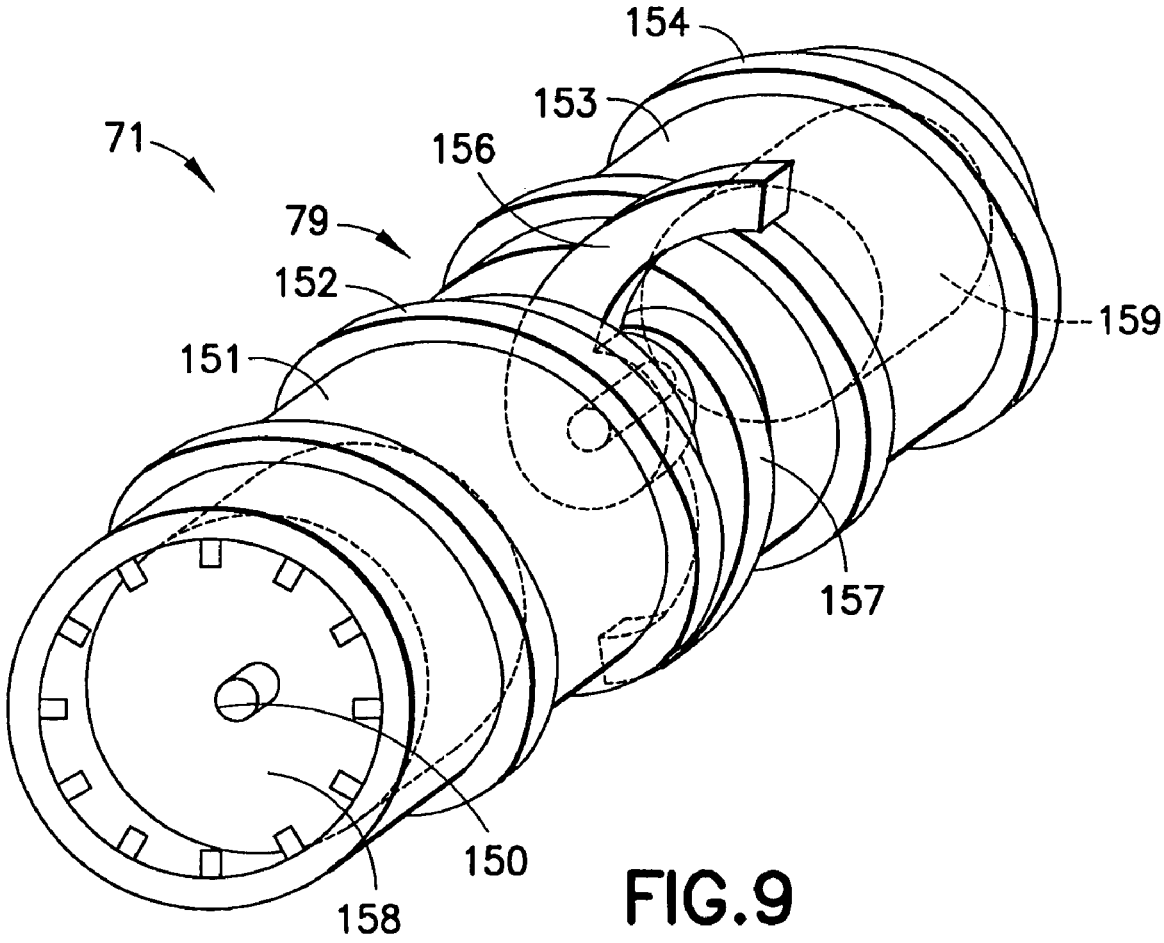
FIG. 9 is a partially cut-away perspective view of the cuttings removal module shown in FIGS. 1 and 2.

Cuttings removal module 71 is shown in detail in FIG. 9. It includes a first cylindrical housing 151 with first spiral cuttings-removal blade 152 mounted thereon, and a second cylindrical housing 153 with second spiral cuttings-removal blade 154 mounted thereon. First and second electric cuttings-removal drive motors 158 and 159 cause housings 151 and 153 to rotate in the same direction so that the rotation of blades 152 and 154 drives mud inflow (72 in FIG. 1) towards the cutting surface of the drill bit (42 in FIG. 2). This mud then carries cuttings through the conduits within the modules of the drill train and into the mud discharge hose (73 in FIG. 1) for disposal.

Cuttings removal module 71 further includes an anti-rotation device 79 that is indicated in FIG. 1 illustrated in FIG. 9. Anti-rotation device 79 is shown in FIG. 9 having first and second cam-shaped arms 156 and 157. Cuttings removal module 71 further includes first and second electric motors 158 and 159. The cylindrical housings, the anti-rotation device and the first and second motors are all mounted to axial shaft 150. The anti-rotation device of the cuttings removal module prevents axial shaft 150 from rotating with respect to the formation surrounding the borehole. Anti-rotation device 79 shown in FIG. 9 has substantially the same design as drilling module anti-rotation device 44 shown in FIG. 8 and discussed above.

Cuttings removal module 71 is shown in FIG. 1 fluid-coupled with second thrust module 61. Module 71 is shown in FIG. 2 rigidly coupled during the drilling process to the second thrust module by a set of three stiffener bars 46. Module 71 is rigidly coupled to the second thrust module during the whole process except during the passage of module 1 or the second thrust module through the curved path between the main well and the branch borehole.

First thrust module 51 and its six-bar mechanisms are described above in reference to FIG. 3. The two six-bar mechanisms of a thrust module now further discussed, in reference to FIGS. 10-19, for the purpose of defining their characteristics, and how they are used in the preferred embodiment.

As stated above, FIG. 3 is a schematic representation of first thrust module 51 supported by first six-bar mechanism 54 and second six-bar mechanism 55. First traction tread 52 and second traction tread 53 are shown in FIG. 3 within the steel casing 23 of cased well 21. Both traction treads are shown in contact with casing 23. First traction tread 52 supports first six-bar mechanism 54. Second traction tread 53 support second six-bar mechanism 55. First traction tread 52 is mounted for motion around a pair of first track wheels 82. First track wheels 82 are mounted to first frame 81. Second traction tread 53 is similarly mounted to second frame 83.

Also as stated above, FIG. 3 shows six-bar mechanism 54 having six rigid bars 91-96, coupled by seven joints A, B, C, D, E, F and G. The joints rotate only in the plane of the six-bar mechanism.

Still referring to FIG. 3, bar 92 is pivotally mounted at its inner end to jointed slider 84. Jointed slider 84 runs along first rail 88 on a first elongated edge of module 51. Bar 93 is pivotally mounted to a fixed point on the first elongated edge of module 51. Bar 96 is pivotally mounted at its inner end to jointed slider 86. Jointed slider 86 runs along second rail 89 on the first elongated edge of module 51. Bar 94 is pivotally mounted at its inner end to jointed slider 85. Jointed slider 85 runs along first rail 88 on the first elongated edge of module 51. Bar 91 is a variable-length portion of the first elongated edge of module 51. Rails 88 and 89 are preferably formed integral with the first elongated edge. Alternatively, rails 88 and 89 are mounted to the first elongated edge.

The two six-bar mechanisms of FIG. 3 are co-planar. Joints A, B, C, D, E, F and G allow each bar to pivot with respect to the next in the plane of the two six-bar mechanisms.

Figure 10:
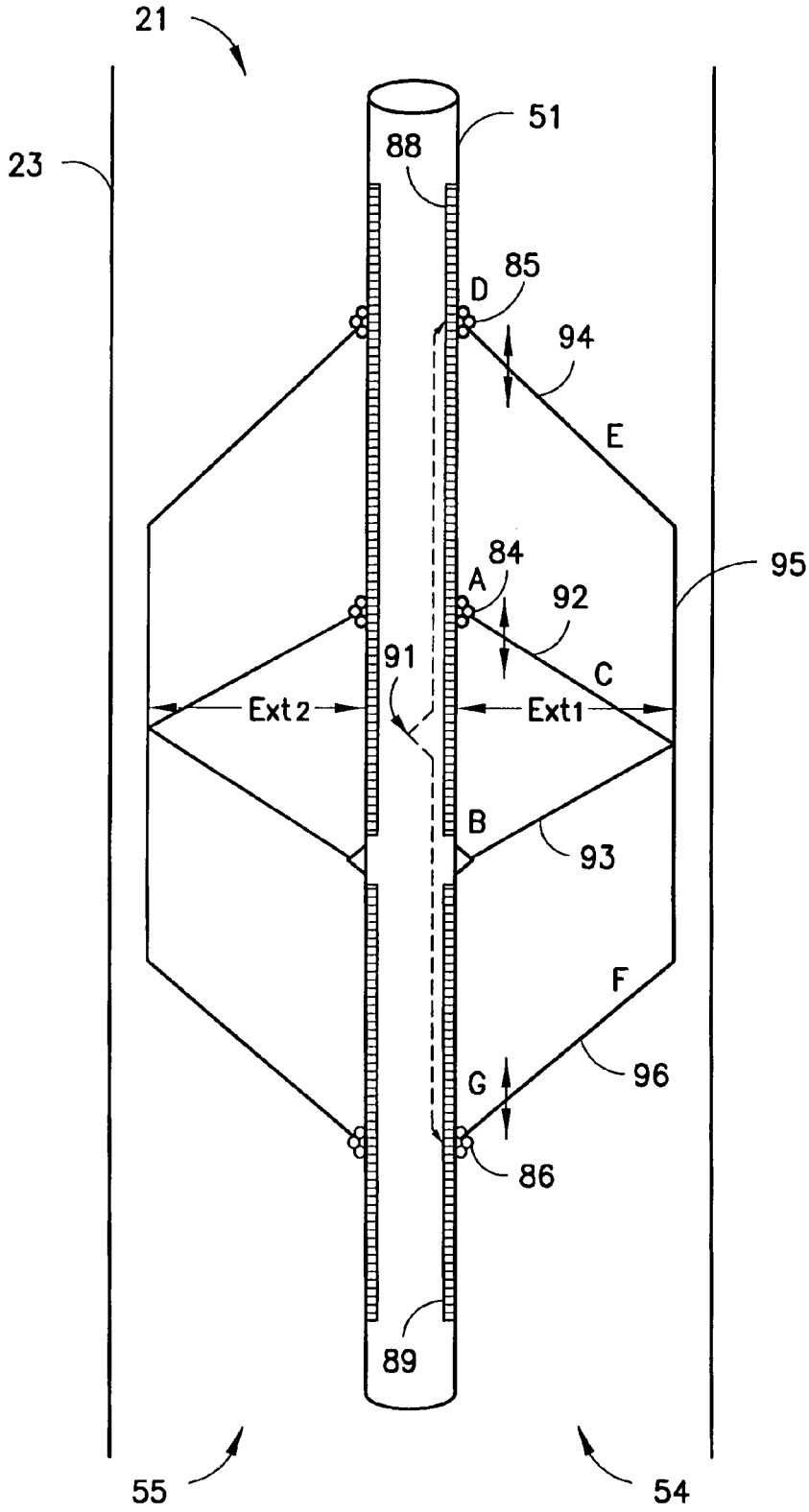
FIG. 10 shows first and second extensions, $E_{xt1}$ and $E_{xt2}$, of first and second six-bar mechanisms, in a side view of the two six-bar mechanisms of the first thrust module of FIGS. 1-3.

Referring now to FIG. 10, joints A, D and G are defined by jointed sliders 84, 85 and 86, respectively. Joint B pivotally attaches the inner end of bar 93 to first bar 91 but does not allow for translation movement of the inner end of bar 93 along bar 91. Joint C allows only pivotal movement of bars 92 and 93 with respect to bar 95. Referring to FIG. 3, bar 95 is illustrated as an elongated fixed-length bar formed integrally to frame 81.

Referring to FIGS. 3 and 10, an inner element of the six-bar mechanism of thrust module 51, consisting of bars 91, 92 and 93 coupled by joints A, B and C, the "ABC" element, may be viewed as an eccentricity control element.

Again referring to FIGS. 3 and 10, an outer element of the six-bar mechanism of thrust module 51, consisting of bars 91, 94, 95 and 96 coupled by joints D, E, F and G, the "DEFG" element, may be viewed as a pivotal control element.

Figure 11:
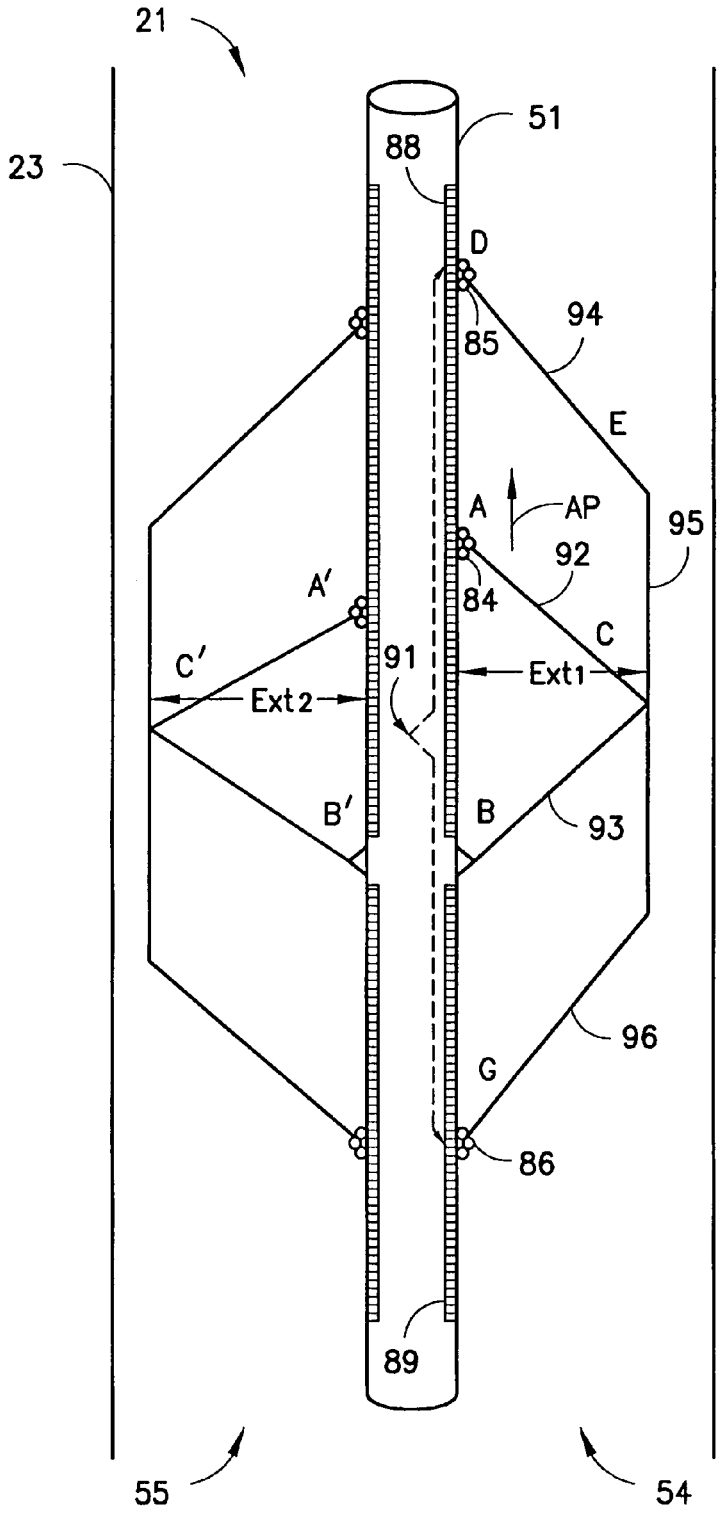
FIG. 11 is a side view of the two six-bar mechanisms of FIG. 10, illustrating the extension-adjusting capability of its first six-bar mechanism.

Now comparing FIGS. 10 and 11, it can be seen that the "ABC" element of first six-bar mechanism 54 has the ability to translate at joint A, and that controlled translation at joint A varies the distance $E_{xt1}$ between bar 91, the base of first six-bar mechanism 54, and bar 95. (Bar 95 corresponds to the long axis of traction tread 52 of FIG. 3). Thus, controlled translation at joint A provides an expansion/contraction capability that can be used to increase or reduce eccentricity by deforming the "ABC" element of first six-bar mechanism 54. (In FIG. 11 joint A' of the "A'B'C'" element of second six-bar mechanism 55 is shown not moved, and the "A'B'C'" element of mechanism 55 is shown more extended from the long axis of thrust module 51 than the "ABC" element of mechanism 54).

Figure 12:
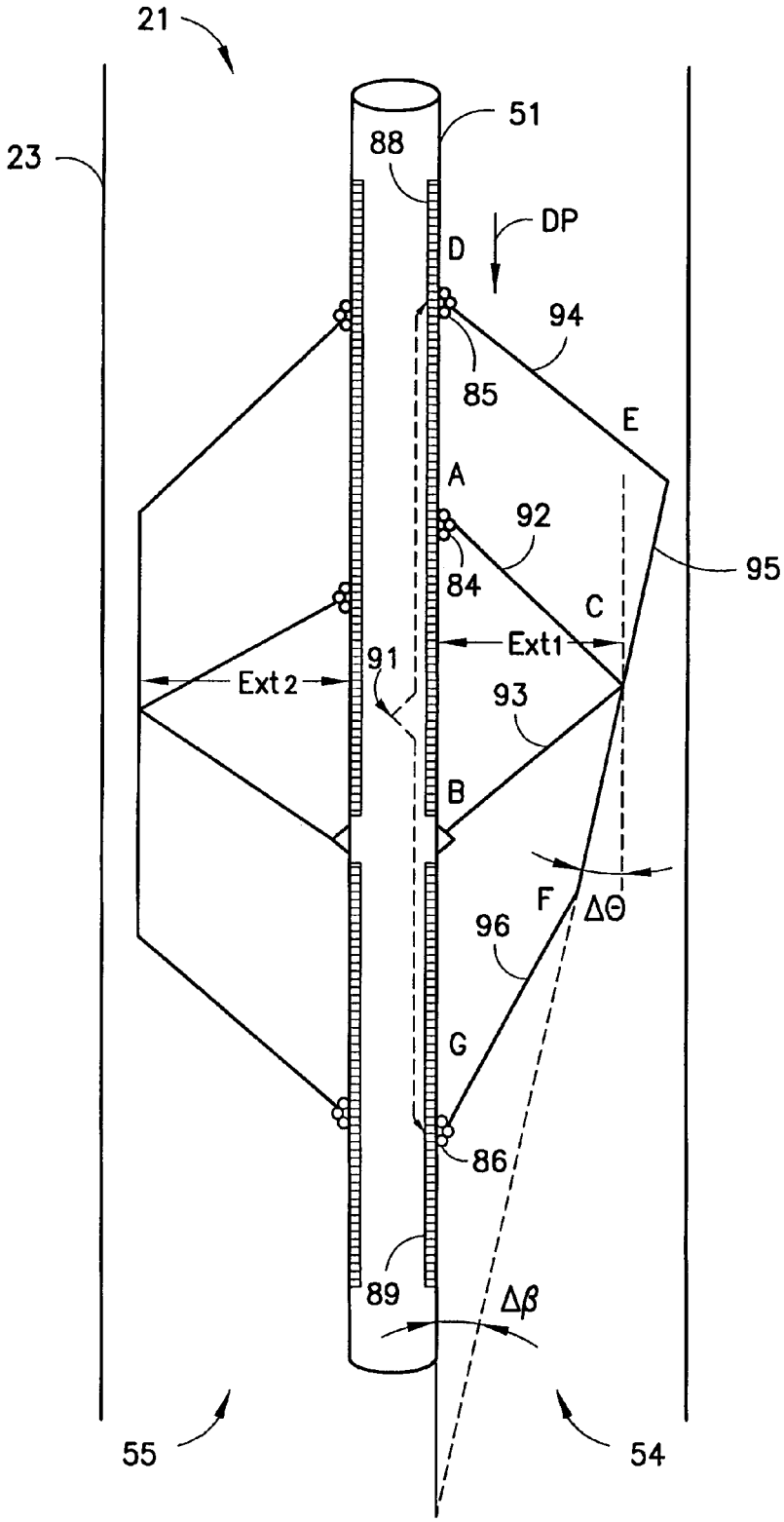
FIG. 12 is a side view of the two six-bar mechanisms of FIG. 10, illustrating the tilt-adjusting capability of its first six-bar mechanism.

Now comparing FIGS. 10 and 12, it can also bee seen that for a given (fixed) setting of the "ABC" element, the "DEFG" element has the ability to translate at joint D (necessitating a compensating translation at joint G). Accordingly, controlled translation of joint D (assuming freedom of movement of joint G), changes the tilt angle between bar 91, the base of six-bar mechanism 54, and bar 95 by $\Delta\beta$. As shown in FIG. 2, $\Delta\beta=\Delta\theta$. Controlled translation of joint D provides a pivotal capability that can be used to change the pivotal orientation of thrust module 51 within the borehole, and accommodate non-parallel borehole walls when used in combination with the corresponding "D'E'F'G'" element of second six-bar mechanism 55. (In FIG. 12, the bar of second six-bar mechanism 55 corresponding to bar 95 of first six-bar mechanism 54 is shown not tilted).

Accordingly, the two six-bar mechanisms of FIGS. 10-12 provide the ability to orient thrust module 51 in eccentricity, and in pivotal orientation within a borehole.

Independent translation at joints A and D of mechanisms 54 and 55 shown in FIG. 3 allows the angle of the axis of each traction tread to be independently set with respect to the axis of module 51. Thus, within limits, the two mechanisms allow the angle of each traction tread to be set to match the angle of the local borehole (which may differ from each other) from any arbitrary angle of module 51 in the borehole. The operator is able to seat firmly each traction tread on the inner wall of the steel casing. Also, the operator is able to set a desired eccentricity for module 51 within the steel casing and is able to pivot module 51 to a desired pivotal orientation within the steel casing.

The structure has one pivotal capability and one expansion/contraction capability on each side. Using the two independent expansion/contraction capabilities together, the system provides the capability to accommodate a range of borehole diameters and can simultaneously establish any eccentricity. Using the two independent pivotal capabilities together, the system can accommodate non-parallel borehole walls and simultaneously provide a selected angle of module 51 with respect to the local axis of the borehole.

The combination of these capabilities provides the flexibility to drill a small-radius transition borehole from the well to the branch borehole.

These capabilities are used for drilling a branch borehole from an oil well at a small angle in a drilling sequence that involves a sequence of drilling operations, alternating between a forward drilling operation and a pivotal drilling operation. Prior to a forward drilling operation, each of bars 92, 94 and 96 are moved along their respective rails and each is locked in a selected position. During the forward drilling operation, the bars remain locked and thrust from the traction treads is conveyed via the first thrust-transmission bar 34 (shown in FIG. 2) to drill module for forward drilling. During a pivotal drilling operation, the bars are moved from their initial position thereby pivoting the first thrust module. Pivoting the first thrust module while it is rigidly attached to the drill module provides pivotal thrust to the drill module for pivotal drilling.

Figure 13:
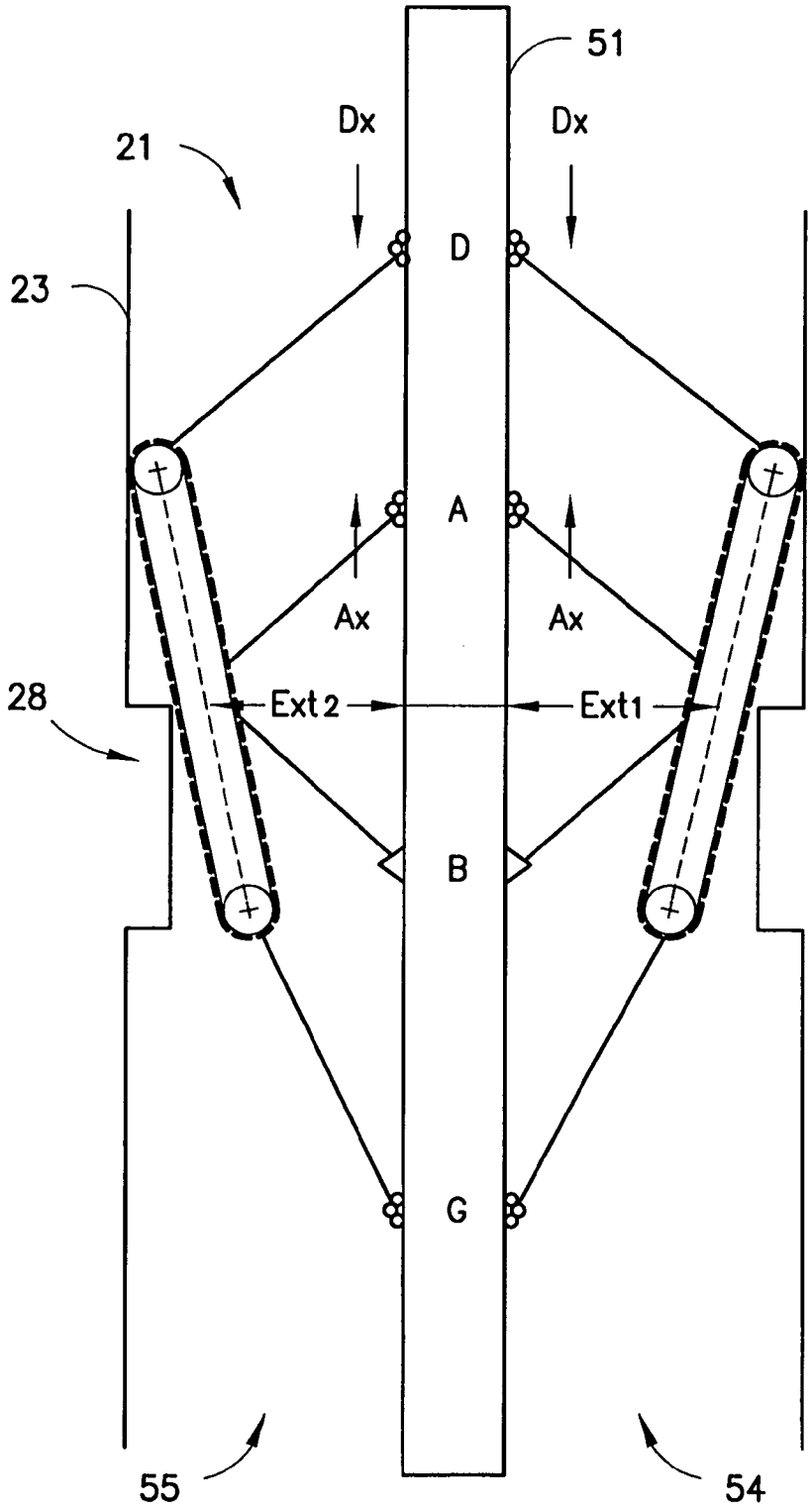
FIG. 13 is a schematic view of a thrust module within the well casing showing how the traction treads mounted to the six-bar mechanisms adapt to a restriction in the steel casing.

FIG. 13 is a schematic view of a thrust module, as located within the steel casing, showing how the traction treads mounted to the six-bar mechanisms adapt to a restriction 28 in steel casing 23. Movement of joint A in the direction indicated by $A_X$ in both six-bar mechanisms reduces extension $E_{xt1}$ and $E_{xt2}$, by equal amount on each side, to accommodate the reduced diameter at restriction 28. Also, movement of joint D in the direction indicated by $D_X$ in both six-bar mechanisms tilts the traction treads to accommodate the first-encountered step of restriction 28.

To position the first thrust module for drilling, the operator must set the orientation of the first thrust module. This requires setting extension $E_{xt1}$ and tilt $\alpha_1$ of first six-bar mechanism 54 and setting extension $E_{xt2}$ and tilt $\alpha_2$ of second six-bar mechanism 55. FIG. 10 and 13 show extension $E_{xt1}$ of mechanism 54, and extension $E_{xt2}$ of mechanism 55. Extensions $E_{xt1}$ and $E_{xt2}$ are independently adjustable.

Figure 14:
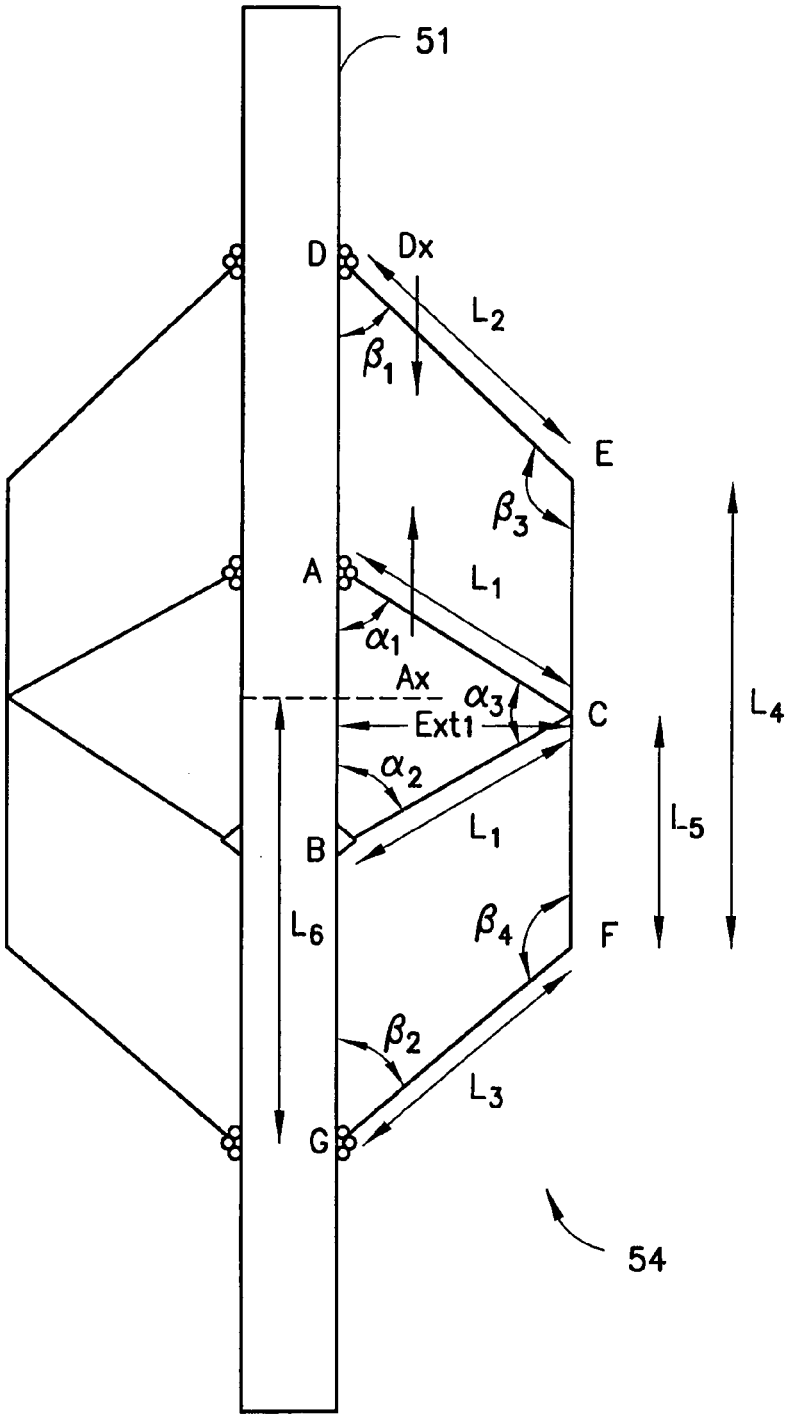
FIG. 14 is a schematic view of the first thrust module identifying the parameters (lengths and angles) that define the structure of the first six-bar mechanism.

FIG. 14 identifies the parameters (lengths and angles) that define the structure of the six-bar mechanism, including parameters $L_6$, $\alpha_1$, and $\beta_1$. All six-bar mechanisms of the drill train, illustrated in FIG. 14 by first six-bar mechanism 54, are instrumented, preferably using conventional angular position sensors (not shown) located at joints and A and G, to measure the length of parameter $L_6$ and the angular values of parameters $\alpha_1$ and $\beta_2$. Thus, the measured parameters are parameters $L_6$, $\alpha_1$ and $\beta_1$.

It can be seen from FIG. 14 that extension $E_{xt1}$ is equal to the length ($L_1$) of bar AC multiplied by sin $\alpha_1$. Since the length of bar BC is also $L_1$, i.e. equal to the length of bar AC, then $\alpha_2$ equals $\alpha_1$.

Accordingly, $$\text{Extension } E_{xt1}=L_1 \sin \alpha_1=L_1 \sin \alpha_2 \qquad \text{Equation 1}$$

Extension $E_{xt1}$ of mechanism 54 is set to a desired value by applying axial push ΔAx to bar AC at joint A in the direction shown in FIG. 14. This will increase $\alpha_1$ and $E_{xt1}$. The value of $\alpha_1$ is continuously monitored and axial push ΔAx is stopped when $\alpha_1$ equals the value corresponding to the desired value of $E_{xt1}$. The value of $\alpha_1$ corresponding to the desired value of $E_{xt1}$ is calculated using the equation:

$$\sin \alpha_1=R_1/L_1 \qquad \text{Equation 2}$$

To enable the operator to set extension $E_{xt1}$ of a given six-bar mechanism of a given thrust module, the value of $\alpha_1$ is preferably monitored and displayed to the operator at a console in the control room while axial push ΔAx is being applied to bar AC.

Figure 15:
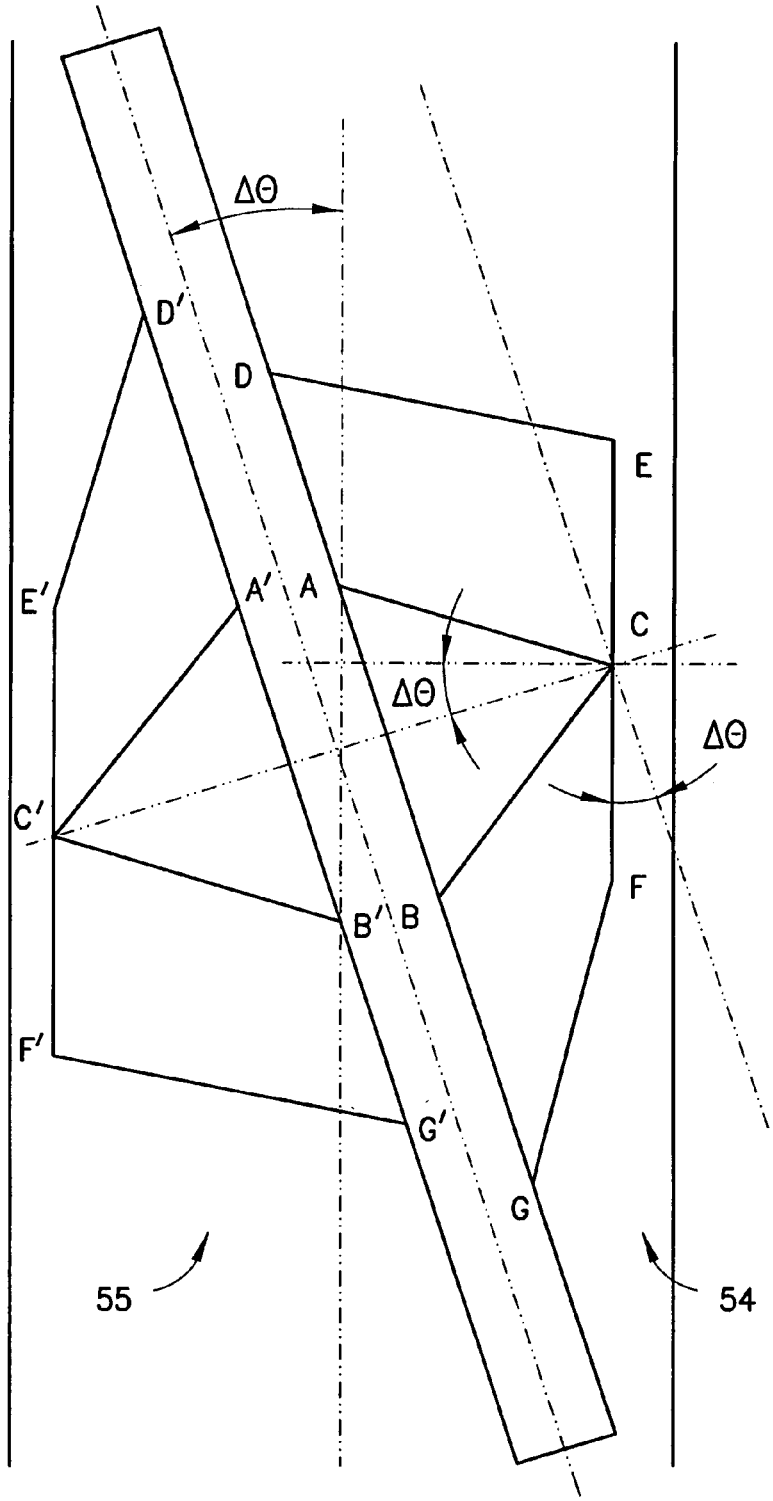
FIG. 15 is a schematic view of the first thrust module in the well casing, illustrating "tilt".

FIG. 15 is a schematic view of the first thrust module with first six-bar mechanism 54 and second first six-bar mechanism 55. FIG. 15 shows the first thrust module tilted Δθ within the well casing. As illustrated, Δθ=22.5°.

Figure 16:
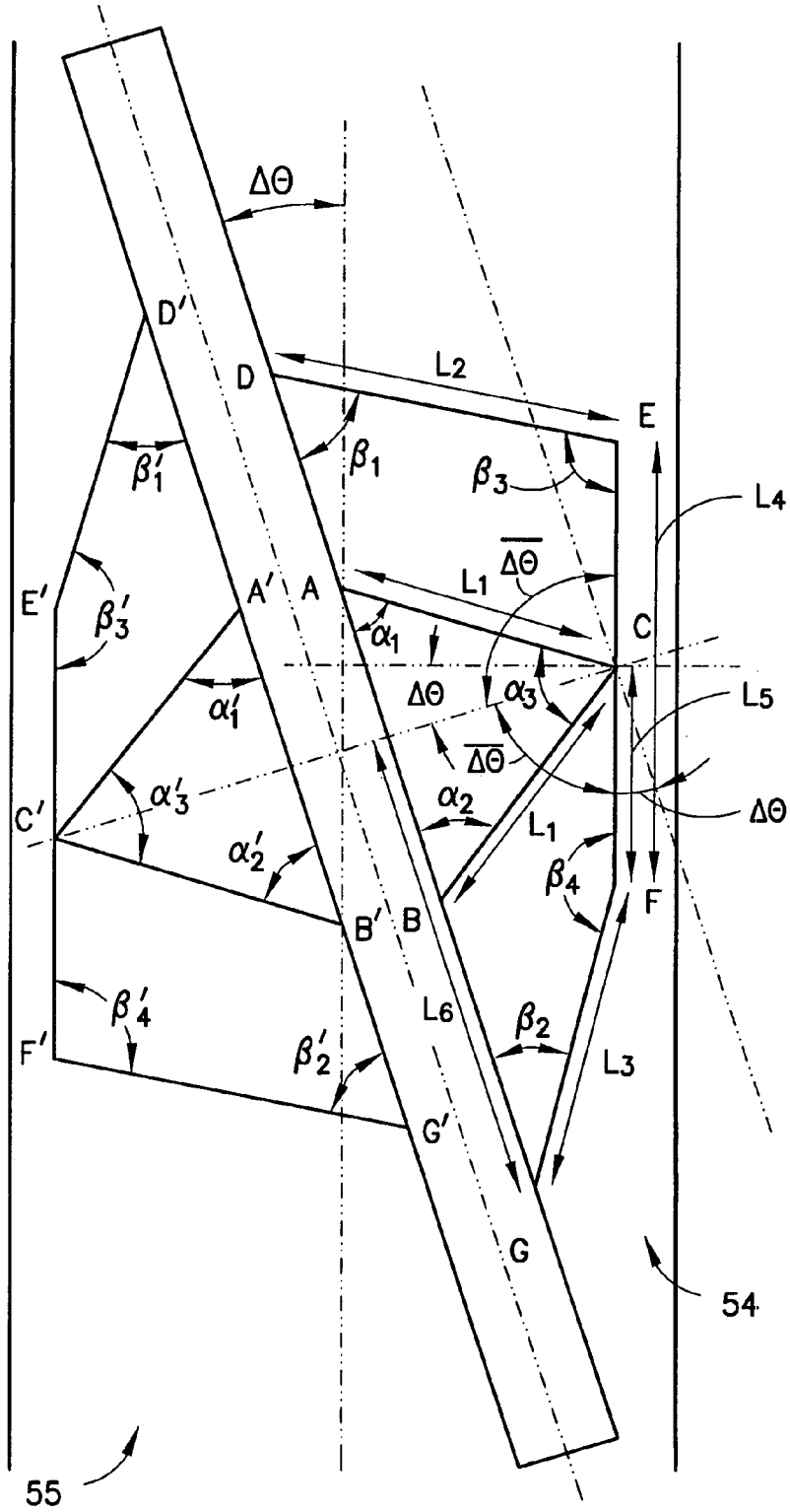
FIG. 16 is a schematic view of the first thrust module identifying all parameters (line lengths and angles) that define extension and tilt configurations of the module's first and second six-bar mechanisms.

FIG. 16 is a schematic view of the first thrust module identifying all parameters (line lengths and angles) that define extension and tilt configurations of the module's first and second six-bar mechanisms. Specifically, FIG. 16 identifies first six-bar mechanism parameters: lengths $L_1$-$L_6$, angles $\alpha_1$-$\alpha_3$ and $\beta_1$-$\beta_4$, and second six-bar mechanism parameters lengths $L_1'$-$L_6'$, and angles $\alpha_1'$-$\alpha'_3$ and $\beta_1'$-$\beta_4'$. These parameters define a particular angle of tilt of the module's first and second six-bar mechanisms and traction treads, respectively. (The traction treads are not shown).

Figure 17:
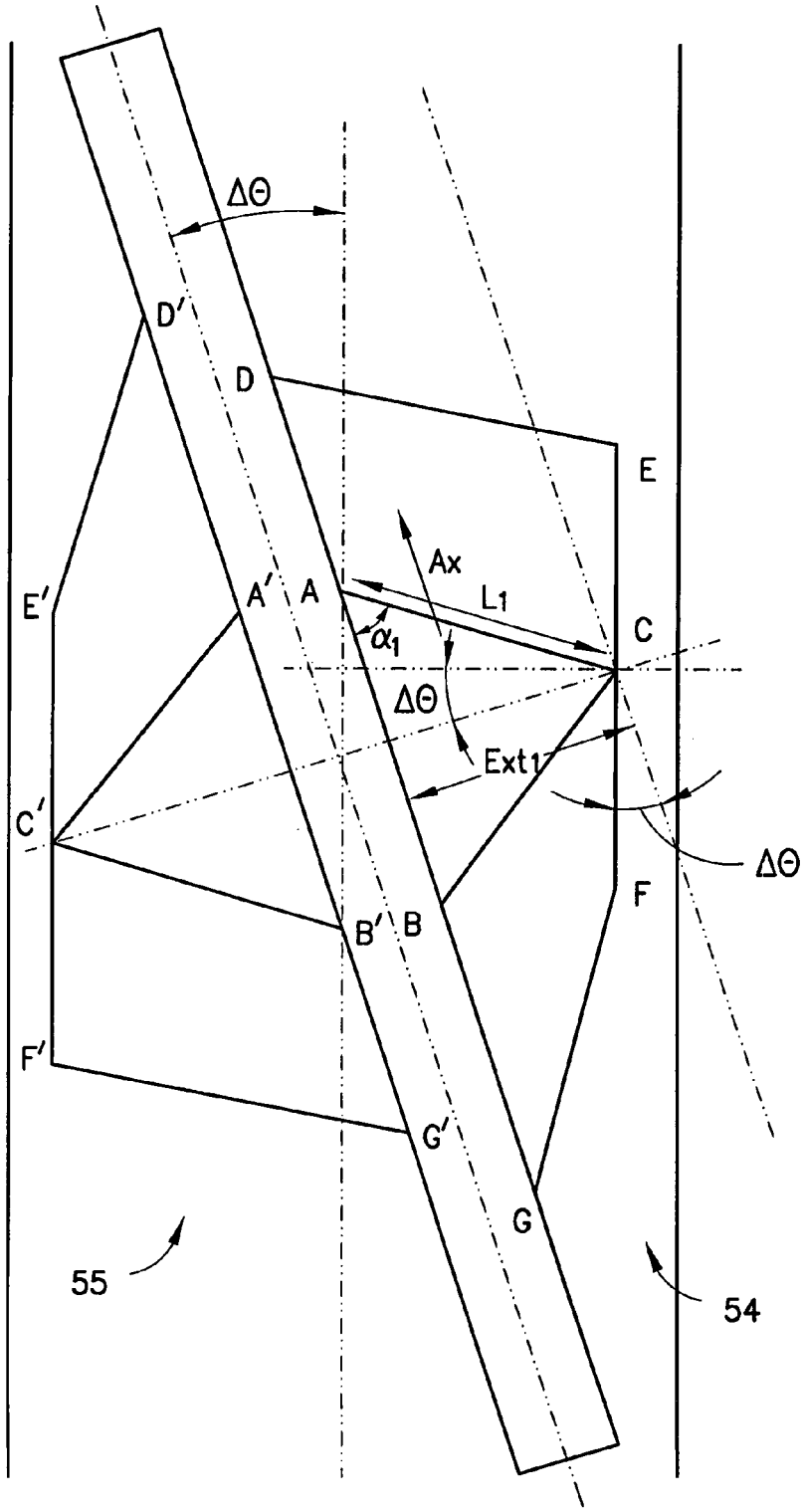
FIG. 17 is a schematic view of the first thrust module identifying the line lengths and angles that define extension of the module's first six-bar mechanism.

FIG. 17 is a schematic view of first six-bar mechanism 54 of the first thrust module when the first thrust module has a tilt of 22.5° and an extension of $E_{xt1}$. FIG. 14 identifies the parameters (lengths and angles) that are used to control $E_{xt1}$. As in FIG. 14, it can be seen from FIG. 17 that extension $E_{xt1}$ is equal to the length ($L_1$) of bar AC multiplied by $\sin \alpha_1$. As noted above in Equation 1, extension $E_{xt1}=L_1 \sin \alpha_1$.

Figure 18:
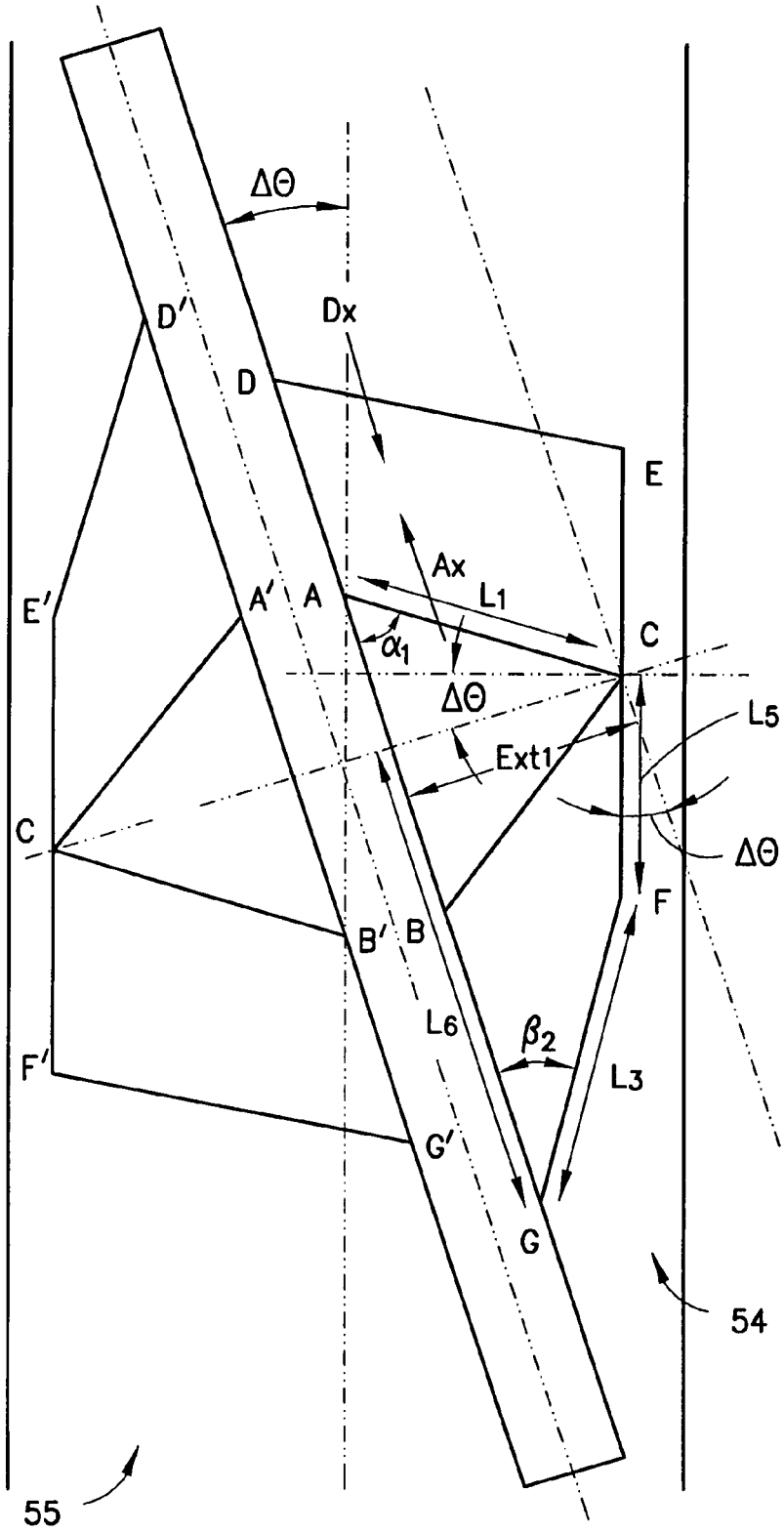
FIG. 18 is a schematic view of the first thrust module identifying all parameters (line lengths and angles) that define a particular tilt of the module's first six-bar mechanism.

FIG. 18 shows angle and line length parameters of first six-bar mechanism 54 of the first thrust module tilted within the well casing. FIG. 18 illustrates the relationship between tilt angle Δθ and the angle $\beta_2$ and line length parameters $L_3$, $L_5$ and $L_6$.

It can be seen from FIG. 18 that $L_6=L_3 \cos \beta_2+L_5 \cos \Delta\theta$. Therefore $$\cos\Delta\theta = \frac{L_6 - L_3\cos\beta_2}{L_5} \qquad \text{Equation 3}$$

In Equation 3, $L_3$ and $L_5$ are fixed lengths. Angle $\beta_2$ is an angle that varies as movements $A_X$ and $D_X$ are applied. Length $L_6$ is a variable length that varies as movements $A_X$ and $D_X$ are applied.

Equations 1 and 3 are used to set extension $E_{xt1}$ and tilt angle Δθ, respectively in first six-bar mechanism 54.

Equations 1 and 2, $R_1=L_1 \sin \alpha_1=L \sin \alpha_2$ and $\sin \alpha_1=R_1/L_1$ respectively, were discussed above in relation to FIG. 14. FIG. 14 shows a thrust module having no tilt. It can be seen from FIG. 17 that equations 1 and 2 also apply to a thrust module having tilt. When the thrust module has tilt, "extension" $E_{xt1}$ is defined as the shortest distance between the first thrust module and joint C. This is illustrated in FIG. 17.

To enable the operator to set the orientation of a given thrust module with respect to the axis of the well during the drilling process, measured position data, or data that enables the values of parameters $\alpha_1$, $\beta_2$ and $L_6$ to be determined, is needed. Preferably, measurements are made and transmitted to the control room for processing while axial push $A_X$ or $D_X$ is being applied. Both measured data from the drill train sensors and processed positional and angular data are preferably displayed in the control room so that the operator can control and monitor movement of the drill train.

Parameters $L_1$, $L_3$ and $L_5$ are fixed lengths whose values are known. Parameters $\alpha_1$, $\beta_2$ and $L_6$ have variable values. The values of $\alpha_1$, $\beta_2$ and $L_6$ may be measured directly, or may be determined from the values of other parameters that can be more easily measured. Determination of the value of $\alpha_1$ enables the value of extension $E_{xt1}$ to be calculated. Determination of the values of $L_6$ and $\beta_2$ enables the value of tilt angle Δθ to be calculated.

Equation 3, $$\cos\Delta\theta = \frac{L_6 - L_3\cos\beta_2}{L_5},$$

is used to calculate a current value of tilt angle Δθ.

Figure 19:
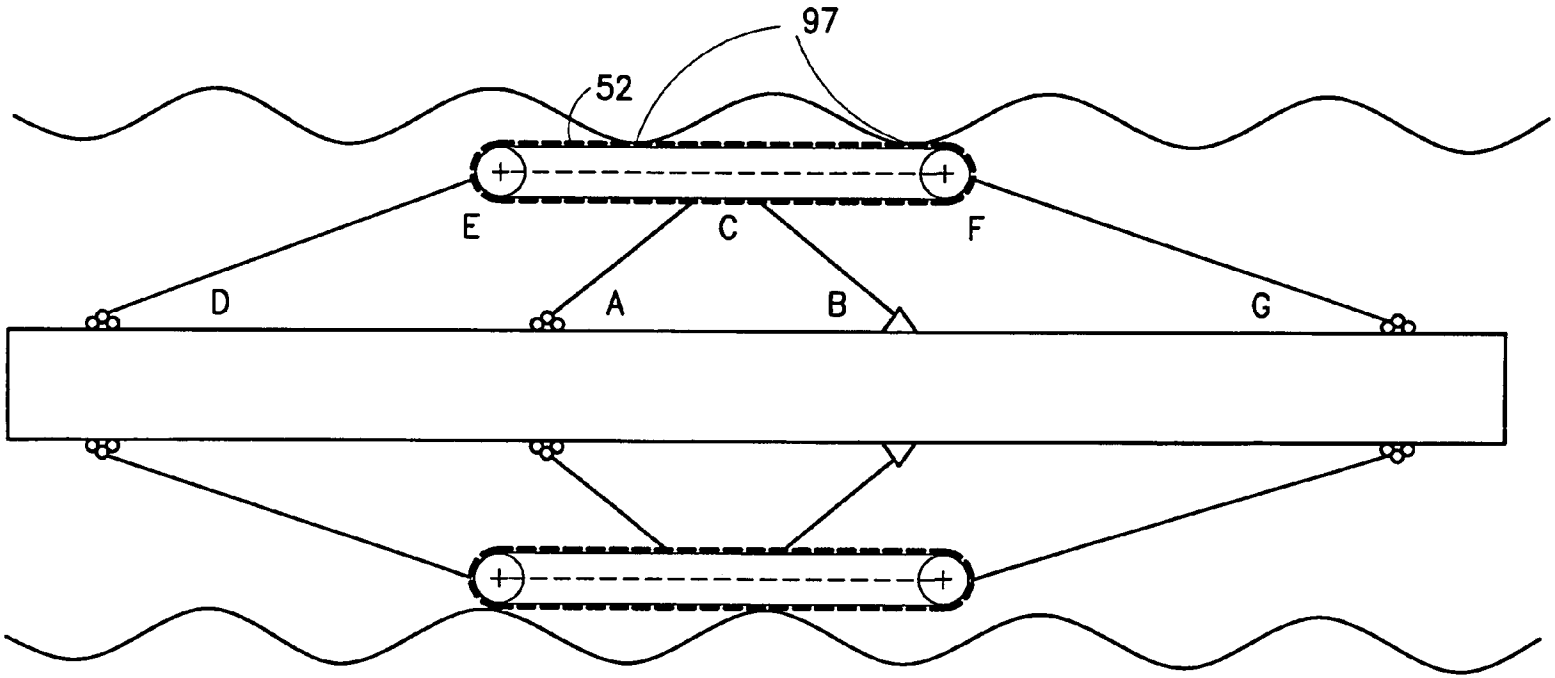
FIG. 19 is a schematic view of the first thrust module within the branch borehole, showing adaptation of the six-bar mechanism to undulations in the borehole wall.

FIG. 19 is a schematic view of the six-bar mechanisms 54 and 55 of first thrust module 51. FIG. 19 shows module 51 within the branch borehole with its axis substantially horizontal, and illustrates the adaptation of first thrust module 51 to undulations 97 in the borehole wall. FIG. 19 shows traction tread 52 between joints E and F in contact with the peaks of undulations 97 in the formation surrounding the borehole.

A first alternative embodiment of the invention includes an inch-worm type thrust module instead of a continuous motion system with tracks. In this first alternative embodiment, the two modules that constitute the inch-worm system reciprocate with respect to each other.

A second alternative embodiment of the invention uses three extendible thrusters instead of the two extendible thrusters of the preferred embodiment. The three extendible thrusters are arranged in a radial array with spacing, one to the next of 120°. In this array, a first extendible thruster is placed directly opposite the side of the well wall in which the borehole is to be drilled, and is aligned in the plane defined by the well axis and planned borehole axis. This ensures that the first extendible thruster will be the extendible thruster that traverses the whipstock, and that it will be centered on the whipstock during the drilling of the step-cut region.

A third alternative embodiment of the invention includes an annular-flow type cuttings removal module.

A fourth alternative embodiment of the invention includes a mud-pump that removes the cuttings.

Detailed Description, Method

The first preferred embodiment of the method for drilling a branch borehole using the apparatus described above includes inserting a whipstock within the steel casing at a selected depth, lowering the drill train to just above the whipstock, and executing an alternating sequence of pivotal drilling steps and forward drilling steps.

Inserting a whipstock includes lowering the whipstock by wireline within the steel casing to a selected depth to fix the depth at which the branch borehole is to be drilled, and adjusting the azimuthal orientation of the sloping top surface of the whipstock (by conventional means) to face the direction at which the branch borehole is to be drilled. The method further includes lowering the drill train within the steel casing by wireline to a selected depth just short of the whipstock, setting the azimuthal orientation of the drill train by conventional means to an azimuthal direction corresponding to the desired azimuthal direction of the planned branch borehole prior to drilling, and executing the alternating sequence of pivotal and forward drilling steps in the direction in which the branch borehole is to be drilled.

The alternating sequence of pivotal and forward drilling steps produces a curved transition portion of branch borehole, shown in FIG. 1 as step-cut region 39. A further series of forward drilling steps produces the elongated straight lateral portion of the branch borehole. The process of drilling the step-cut region and completing the planned branch borehole can be viewed as a series of stages, each stage including a series of steps. Table 1 below lists the key stages of the drilling process of the first preferred embodiment. Each of the stages 0-9 in Table 1 is illustrated by one of FIGS. 20-29. In FIGS. 20-29, the cuttings removal module and its associated linkage are not shown because the cuttings removal module plays no active part in maneuvering the drill bit through the borehole cutting process.

Referring to Table 1 below, and to FIGS. 20-29, the stages and steps are described in detail as follows.

locked in a straight, rigid linear array, and the traction treads are not in contact with the steel casing. The drill train is still supported by the wireline.

Figure 20:
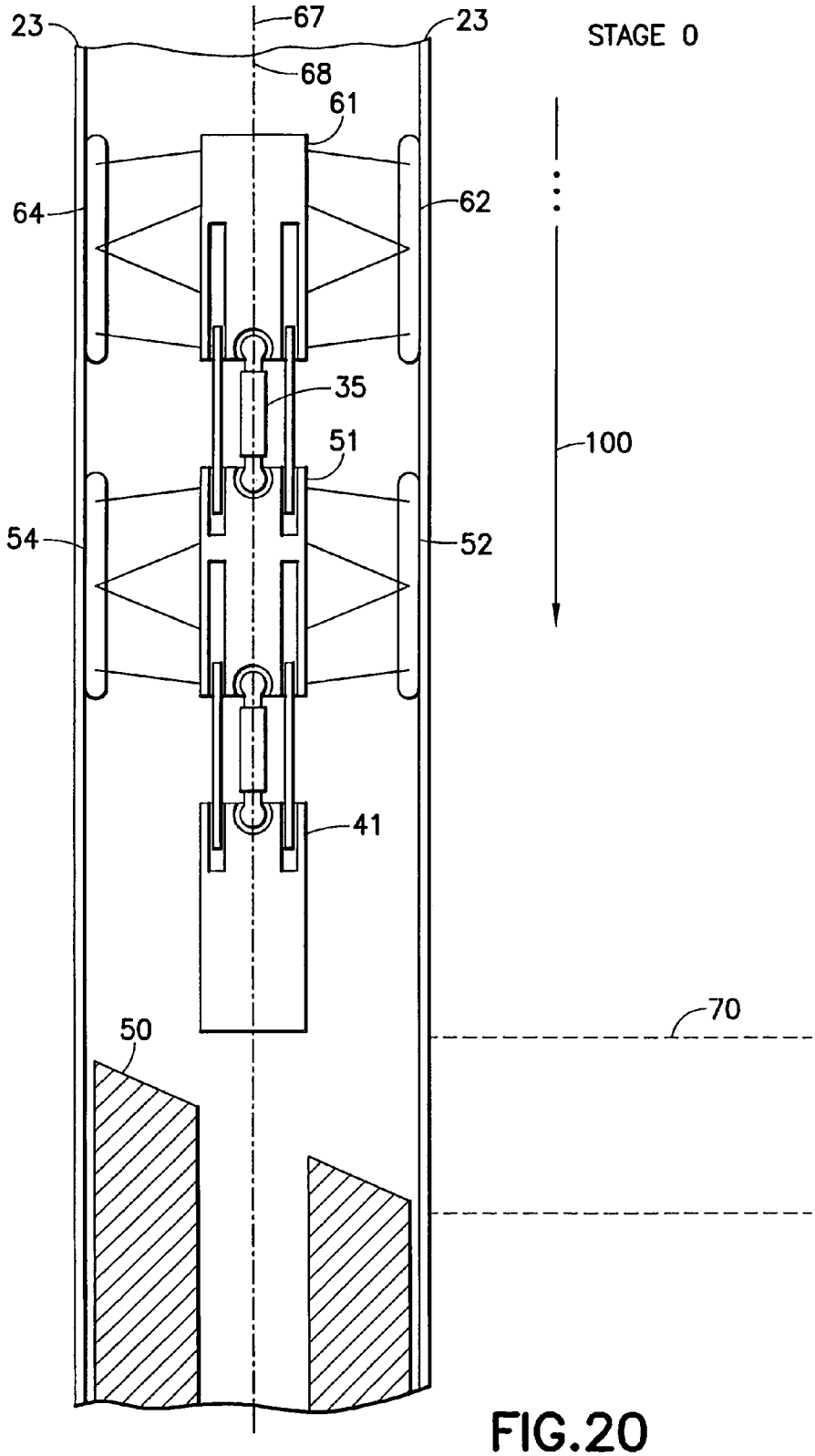
FIG. 20 is a schematic view of modules 41, 51 and 61 of the drill train at the completion of stage 0.

At this point, the four six-bar mechanisms associated with the two thrust modules are activated to equally increase the extension of the associated four traction treads until all four traction treads are in contact with the steel casing, as shown in FIG. 20. With the drill train now supported by the four traction treads, tension on the wireline is released to allow further movement of the drill train to be controlled by traction track drive alone. FIG. 20 shows the drill train is in a rigid, in-line configuration, centered within the local steel casing. The axis of the drill train is co-axial with axis of the local steel casing, and the eccentricity of both the first thrust module and the second thrust module is zero.

Stage 1: Setting Initial Eccentricity of the First and Second Thrust Modules In Stage 1, the eccentricity of both the first thrust module and the second thrust module is changed, as illustrated by the difference between FIGS. 20 and 21, to move the drill train, in its rigid, in-line configuration, closer to the side of the casing

TABLE 1

| | Drilling Module | | | | First Thrust Module | | | Second Thrust Module | | |
|---|---|---|---|---|---|---|---|---|---|---|
| Module: Stage | $\Delta E_{cc}$ | Change of tilt $\Delta\theta$ | Tilt Angle $\Delta\theta$ | Axial Translation | $E_{cc}$ | Tilt Angle $\Delta\theta$ | Forward Drive | $E_{cc}$ | Change of Tilt $\Delta\theta$ | Forward Drive Yes/No |
| 0. Setting Depth | Yes | None | 0.0 | Up to Setting Depth | No | 0.0 | No | No | No | No |
| 1. Setting Eccentricity | Yes | None | 0.0 | None | Yes | 0.0 | No | Yes | No | No |
| 2. 1st Setting Module Tilt | No | 22.5° | 22.5 | None | No | 22.5° | No | No | No | No |
| 3. 1st Pivotal Drilling | No | 22.5° | 22.5° | None | No | 22.5° | No | No | No | No |
| 4. 1st Forward Drilling | No | None | 22.5° | 0.3 m | No | 22.5° | Yes | No | No | Yes |
| 5. Changing Eccentricity | Yes | None | 22.5° | None | Yes | 22.5° | No | Yes | No | No |
| 6. 2nd Pivotal Drilling | No | 45° | 45° | None | No | 45° | No | No | No | No |
| 7. Fwd Drilling, Tilting Tread 52 | No | None | 45° | 0.3 m | No | 45° | 0.3 m | No | No | 0.3 m |
| 8. Fwd Drilling, Tilting Tread 53 | No | None | 45° | 0.3 m | No | 45° | 0.3 m | No | No | 0.3 m |
| 9. 3rd Pivotal Drilling | No | 22.5° | 67.5° | None | No | 67.5° | No | No | No | No |
| 10. Fwd Drilling, Straightening Drill Train | No | None | 67.5° | 0.3 m | No | 67.5° | 0.3 m | No | Yes | 0.3 m |
| 11. Continuous Forward Drilling | No | None | 67.5° | Can be 100 m | No | 67.5° | Yes | No | No | Yes |

Stage 0: Setting Drill Train Initial Configuration and Depth

The drill train, comprising the three modules shown in FIG. 20 plus the cuttings removal module, with all stiffener bars inserted, is lowered at the end of the wireline to a location just above the whipstock. This movement is indicated by arrow 100 in FIG. 20. Before the drill train is lowered, the traction treads are set at low extension so they do not contact the casing on the way down. Accordingly, when the drill train is in its initial position at the desired depth, the four modules are through which the borehole is to be drilled. In stage 1, referring to FIG. 21, arrow 101 defines the direction and distance of this movement. Specifically, the first thrust module and the drill module that are rigidly coupled to each other are properly positioned to begin an initial tilting to prepare for a first pivotal drilling step. Also, the second thrust module is properly positioned at an eccentricity of +0.5 (69) to provide additional drive force for a first forward drilling step following the first pivotal drilling step. Eccentricity of a thrust module in a well is applicable only when the axis of the thrust module is parallel to the axis of the well. Eccentricity $E_{cc}$ is the shortest distance between the well axis (67) and the thrust module axis (68), expressed as a fraction of the total available eccentricity in a range −0.5 to +0.5 (double arrow 69). $E_{cc}$ is a positive number on the same side of the well as the planned borehole, and a negative number on the opposite side of the well from the planned borehole. The length of this movement in stage 1 "Setting Initial Eccentricity" is indicated by the length and direction of arrow 101.

Stage 2: Setting Initial Tilt of the First Thrust Module

Figure 22:
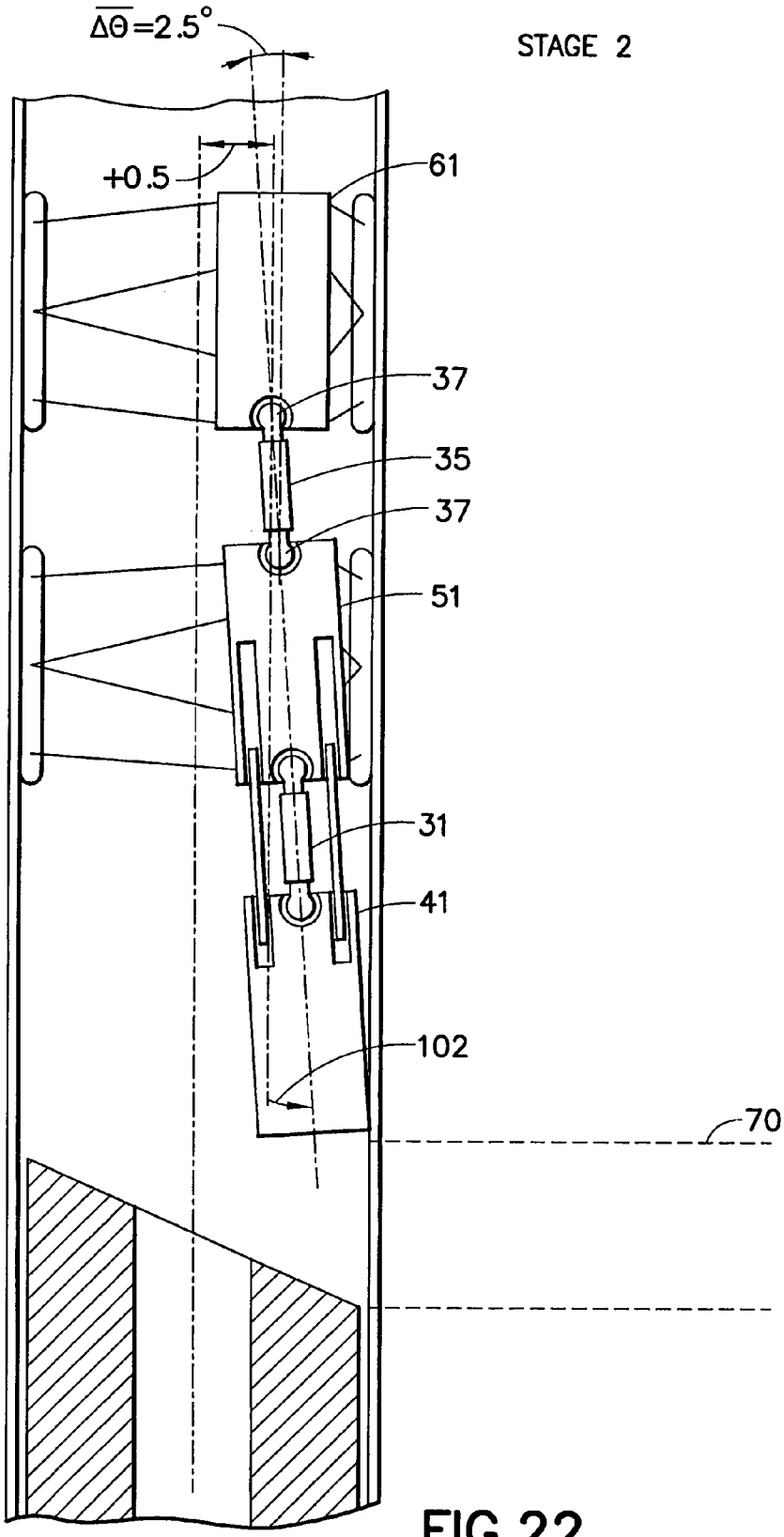
FIG. 22 is a schematic view of modules 41, 51 and 61 of the drill train at the completion of stage 2.

In Stage 2, referring to FIG. 22, the stiffeners between the first and second thrust modules are retracted to allow the knuckle joints 37 of second thrust-transmission bar 35 to pivot freely. The stiffeners between the first thrust module and the drill module remain inserted.

The first thrust module, along with the drill module to which it is rigidly coupled, is tilted by activating the two six-bar mechanisms of the first thrust module. The first thrust module and the drill module pivot about the geometric center of the first thrust module.

Figure 21:
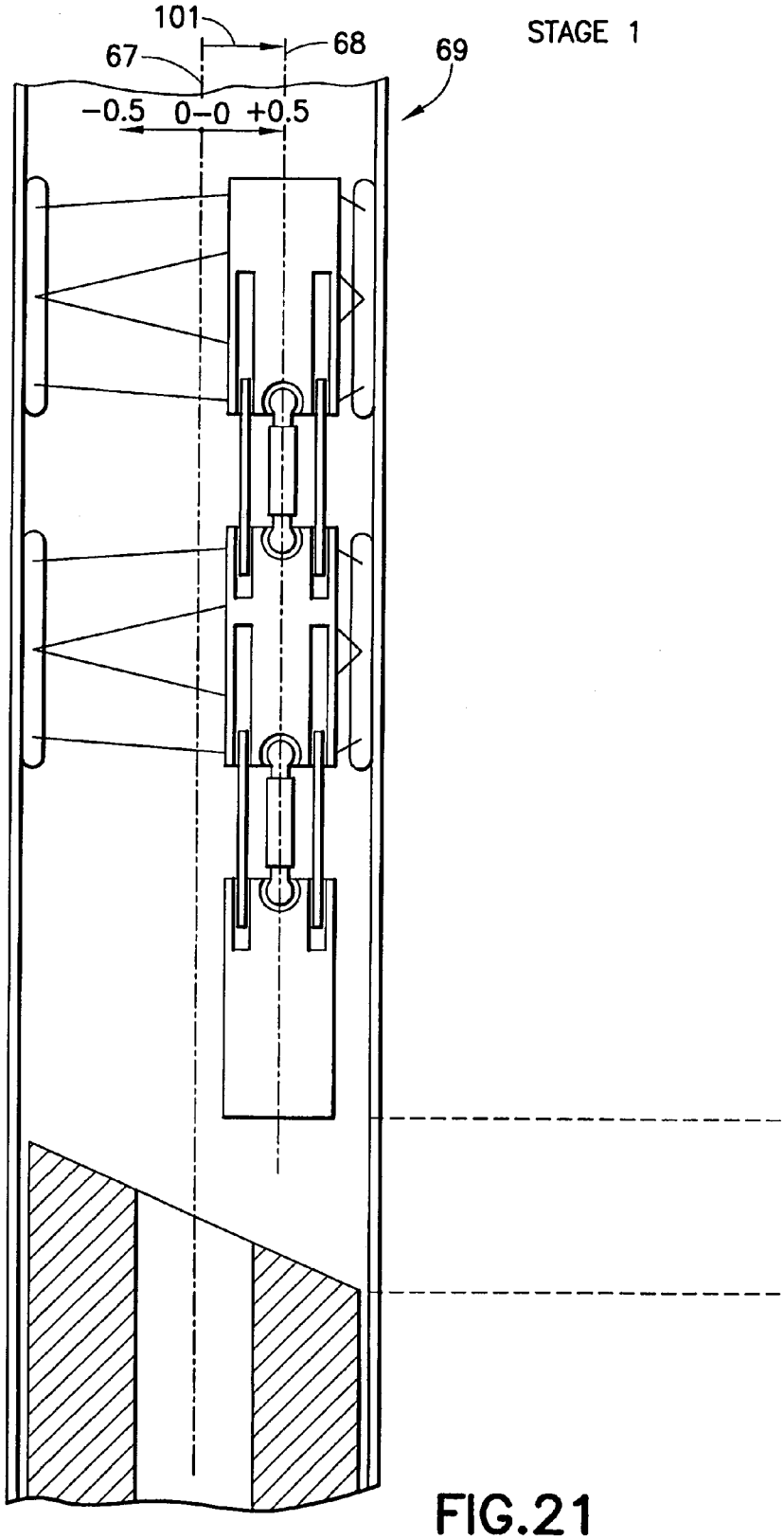
FIG. 21 is a schematic view of modules 41, 51 and 61 of the drill train at the completion of stage 1.

These tilting steps are represented by the differences between FIGS. 21 and 22.

FIG. 22 shows the rigidly coupled first thrust module and the drill module tilted to a tilt angle of $\overline{\Delta\theta}$, shown as equal to 2.5°, the second thrust module aligned with the well axis but having eccentricity, and bar 35 free to pivot. With bar 35 free to pivot, and the drill bit in contact with the casing, the three modules are now in condition to execute a first pivotal drilling.

Stage 3: First Pivotal Drilling

Figure 23:
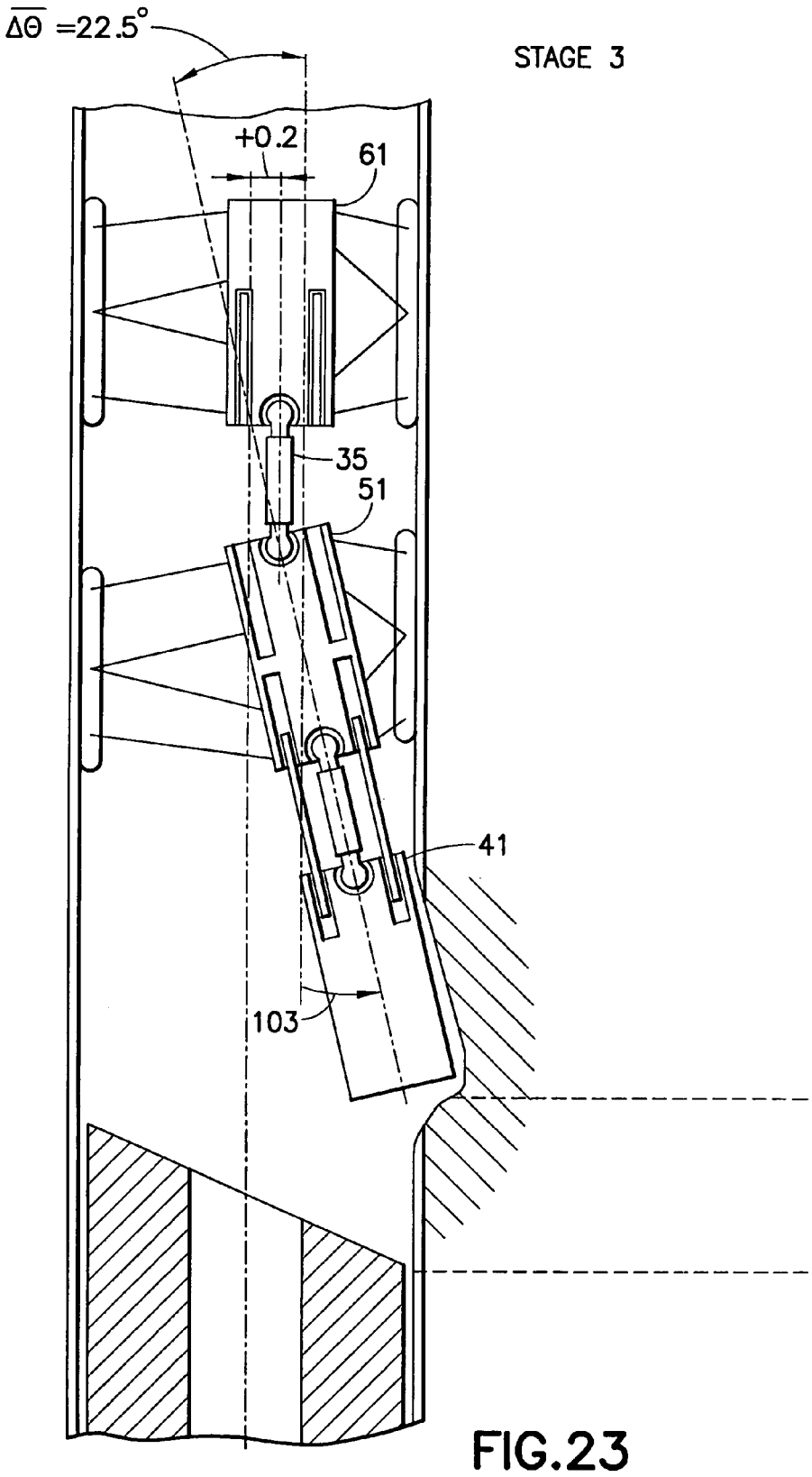
FIG. 23 is a schematic view of modules 41, 51 and 61 of the drill train at the completion of stage 3.

In Stage 3, referring to FIG. 23, the second thrust module remains stationary while the six-bar mechanism drives the sub-assembly of first thrust module and the drill module in pivotal motion about the geometric center of the first thrust module, as defined by arrow 103. This pivoting motion, along with powering the drill bit, executes a first pivotal drilling step. The first pivotal drilling step is represented by the differences between FIGS. 22 and 23. At the end of the first pivotal drilling step, second thrust module 61 and bar 35 are aligned parallel to the axis of the well with module 61 at an eccentricity of +0.2, in preparation for delivering thrust from the second thrust module to the first thrust module in the first forward drilling step to follow. Also, in preparation for beginning the first forward drilling step, the sub-assembly of first thrust module and the drill module is at a tilt angle $\overline{\Delta\theta}$=22.5° with respect to the well axis. The value of tilt angle $\overline{\Delta\theta}$ will increase through all following pivotal stages until the drill module is forward drilling in the branch borehole, at which point tilt angle $\overline{\Delta\theta}$=90°. In Table 1 above, $\Delta\theta$ is the arc of pivotal motion of the drill module during execution of a pivotal drilling step or a pivotal motion step and $\overline{\Delta\theta}$ is the total, i.e. cumulative, tilt angle.

Stage 4: First Forward Drilling

Figure 24:
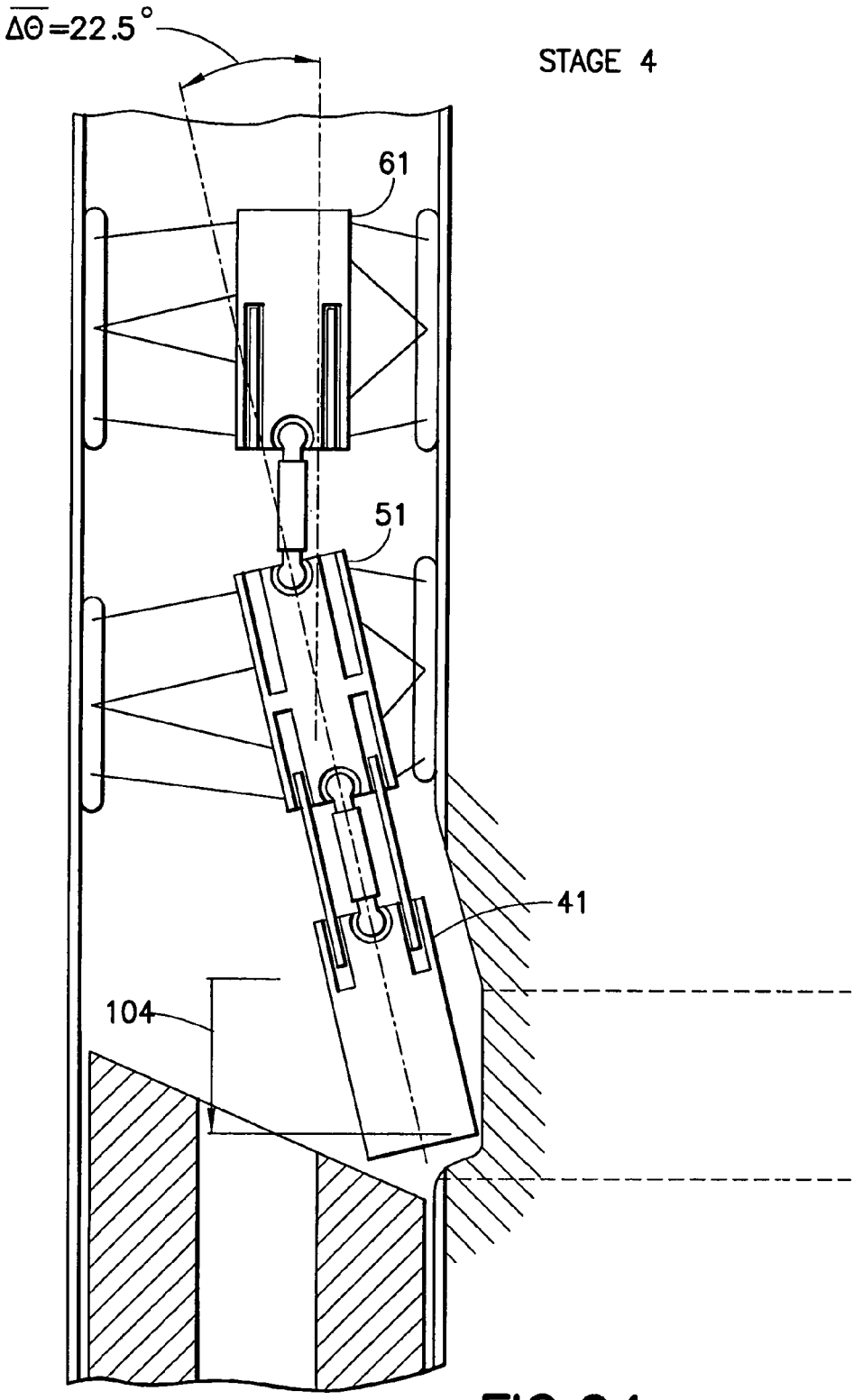
FIG. 24 is a schematic view of modules 41, 51 and 61 of the drill train at the completion of stage 4.

In Stage 4, both thrust modules tractor forward in a motion defined by arrow 104 in FIG. 24. This motion, along with powering the drill, executes a first forward drilling step. It cuts a first slice of the planned branch borehole, as illustrated by the differences between FIGS. 23 and 24. This first forward drilling step drills transverse to the axis of the planned branch borehole. Tilt angle $\overline{\Delta\theta}$ remains 22.5°.

Stage 5: Changing Eccentricity of Second Thrust Module

Figure 25:
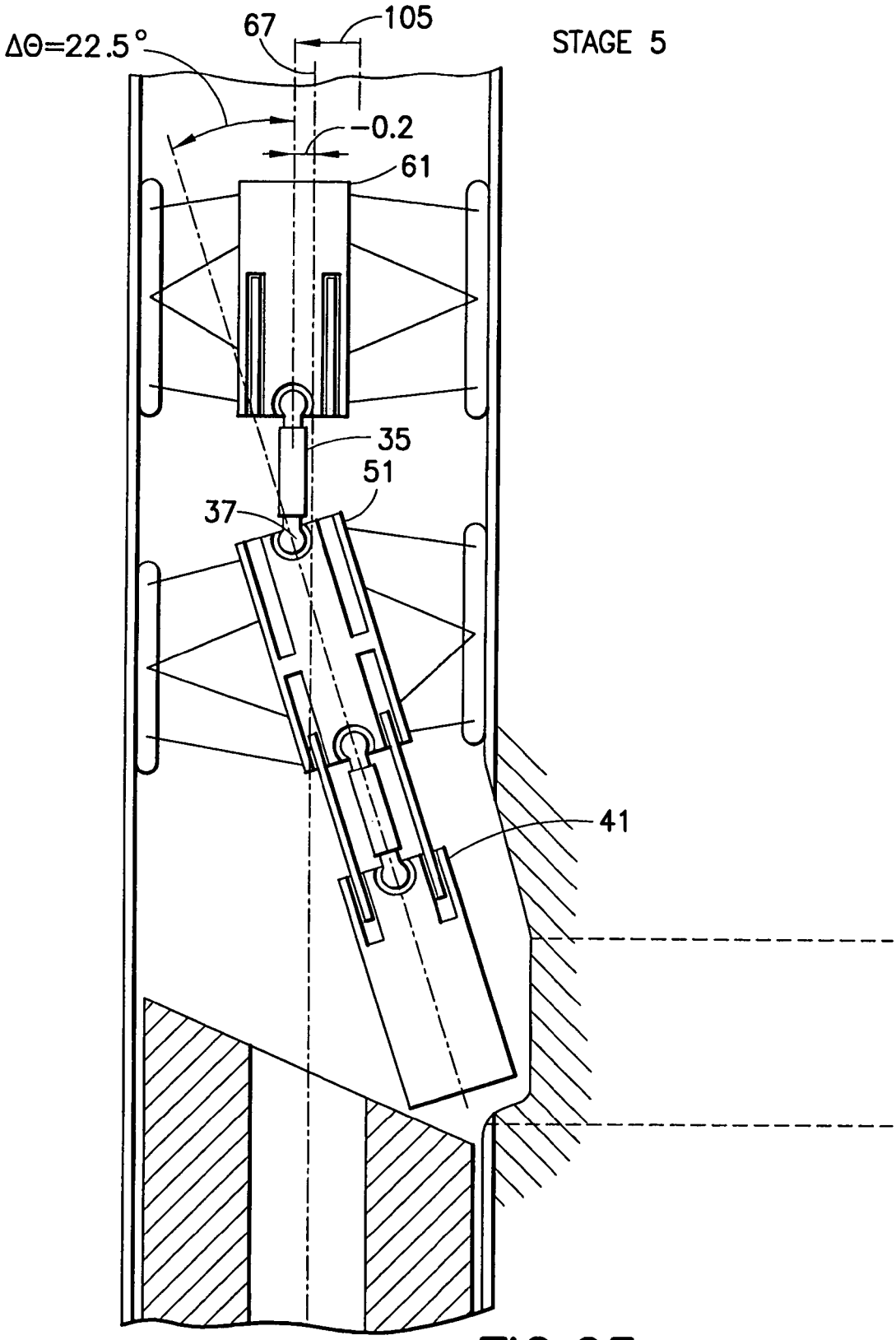
FIG. 25 is a schematic view of modules 41, 51 and 61 of the drill train at the completion of stage 5.

In Stage 5, eccentricity $E_{cc}$ of second thrust module 61 is changed. Both thrust modules are moved an equal distance further away from the casing wall closest to the planned branch borehole. This motion, defined by arrow 105 in FIG. 25, is accomplished by activating the four six-bar mechanisms associated with the two thrust modules. By moving both modules an equal distance, the alignment of bar 35 parallel to the axis of the well is maintained. Thus, second thrust module 61, the thrust module whose axis is parallel to the well axis, is positioned to execute a forward drilling step, after the second pivotal drilling step, providing additional thrust via thrust-transmission bar 35, with second thrust module 61 eccentricity $E_{cc}$=−0.2. (Eccentricity $E_{cc}$=−0.2 is indicated in FIG. 25 at 70). Tilt angle $\overline{\Delta\theta}$ remains 22.5°. The sub-assembly of first thrust module and drill module is now properly positioned for immediate execution of a second pivotal drilling step.

Stage 6: Second Pivotal Drilling

Figure 26:
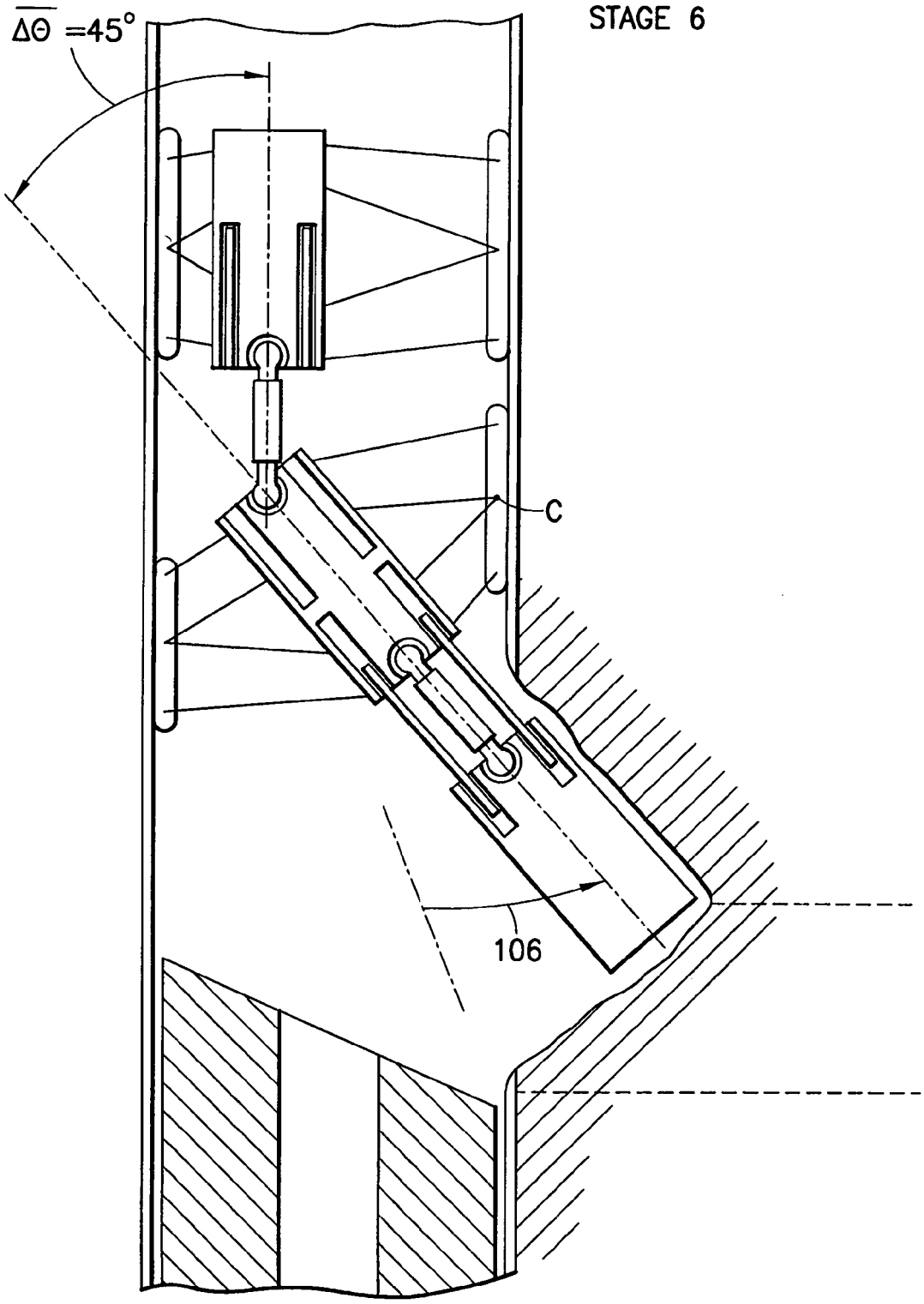
FIG. 26 is a schematic view of modules 41, 51 and 61 of the drill train at the completion of stage 6.

In Stage 6, referring to FIG. 26, the second thrust module remains locked in place while the six-bar mechanism drives the assembly of first thrust module and drill module in pivotal motion to make a cut into the step-cut region of the planned branch borehole. The assembly pivots about the geometric center of the first thrust module through the arc defined by arrow 106 in FIG. 26. This pivoting motion, along with powering the drill, executes the second pivotal drilling step for a change of tilt angle $\Delta\theta$=45°. The pivoting motion is illustrated by the differences between FIGS. 25 and 26. Tilt angle $\overline{\Delta\theta}$ is now 67.5°.

Stage 7: Forward Drilling and Tilting Tread 52

Figure 27:
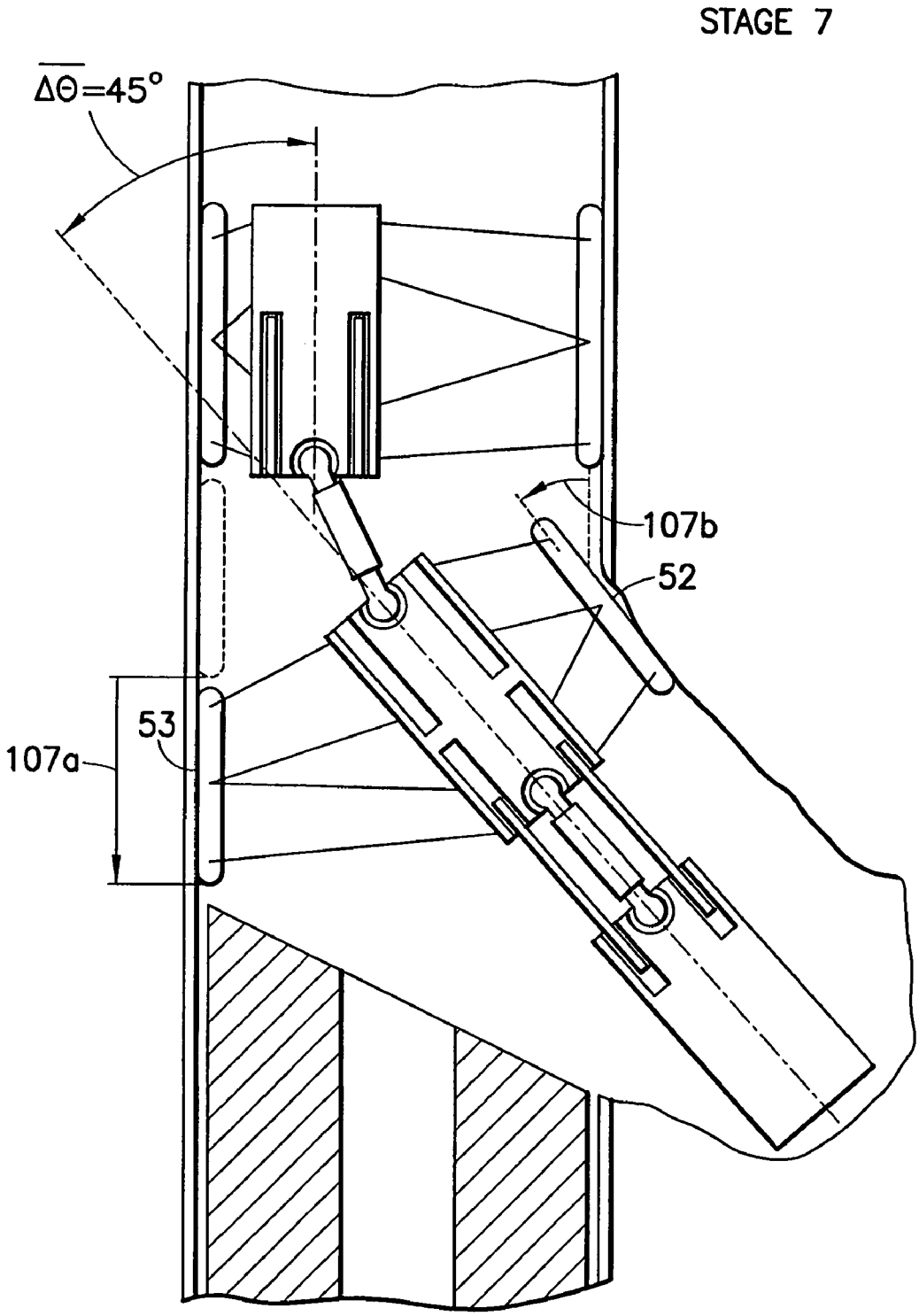
FIG. 27 is a schematic view of modules 41, 51 and 61 of the drill train at the completion of stage 7.

In Stage 7, referring to FIG. 27, the second thrust module is unlocked, and the first and second thrust modules tractor forward in a motion defined by arrow 107*a*. This motion, along with powering the drill, executes a second forward drilling step. It cuts a second slice of the planned branch borehole, as illustrated by the differences between FIGS. 26 and 27. This second forward drilling step also drills transverse to the axis of the planned branch borehole.

Forward drilling occurs as traction tread 53 moves down as illustrated by arrow 107*a*, and traction tread 52 pivots in the direction indicated by arrow 107*b*. Tilt angle $\overline{\Delta\theta}$ remains at approximately 45°.

Stage 8: Forward Drilling and Tilting Tread 53

Figure 28:
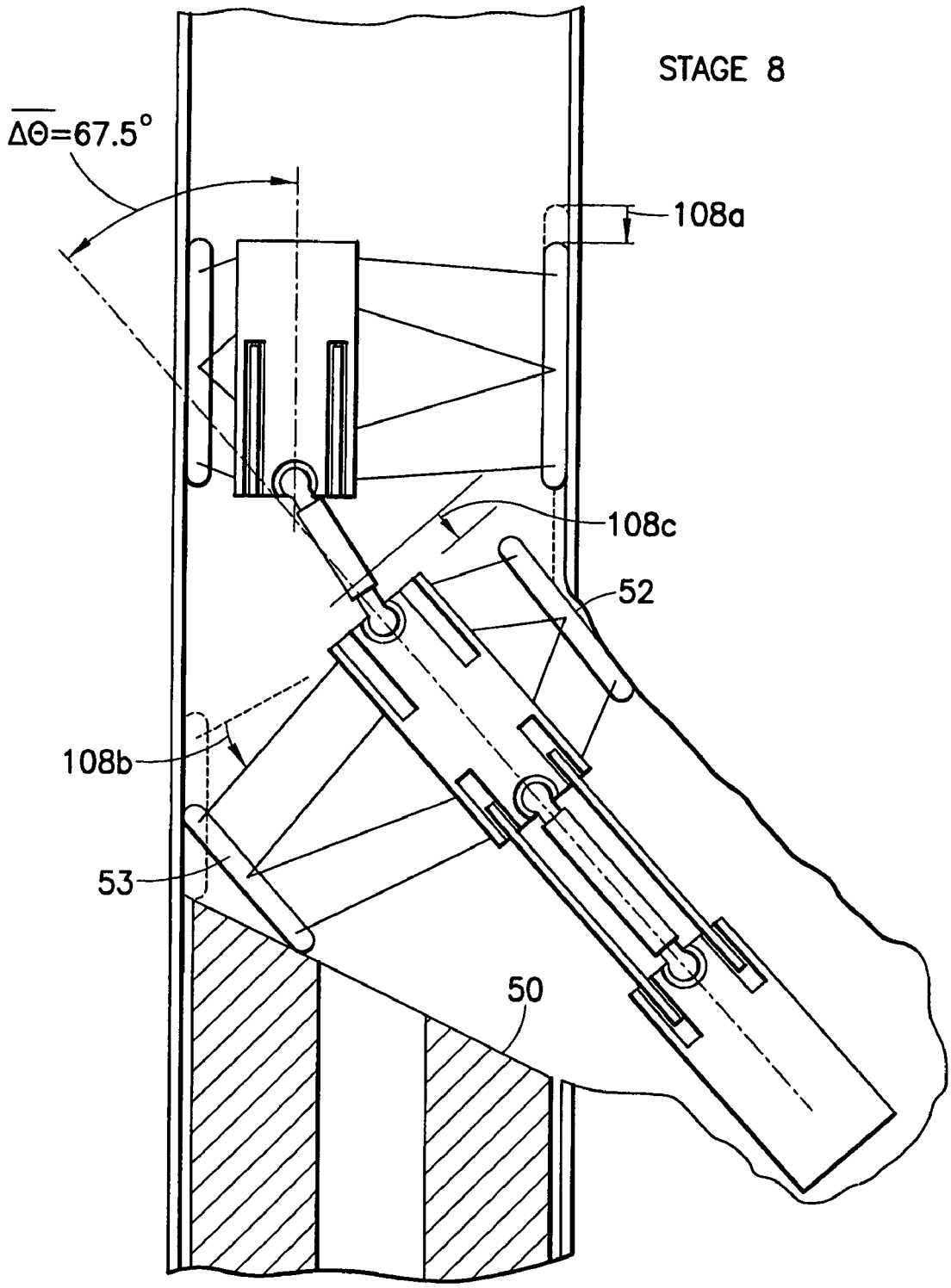
FIG. 28 is a schematic view of modules 41, 51 and 61 of the drill train at the completion of stage 8.

In Stage 8, referring to FIG. 28, the first and second thrust modules tractor forward in a motion defined by arrows 108*a*, 108*b* (forward tractoring, pivoting motion of traction tread 53), and 108*c*. This motion, along with powering the drill, executes a forward drilling step. More importantly, it also moves traction tread 53 into position to tractor across the upper surface of whipstock 50. Tilt angle $\overline{\Delta\theta}$ remains at approximately 45°.

Stage 9: Third Pivotal Drilling

Figure 29:
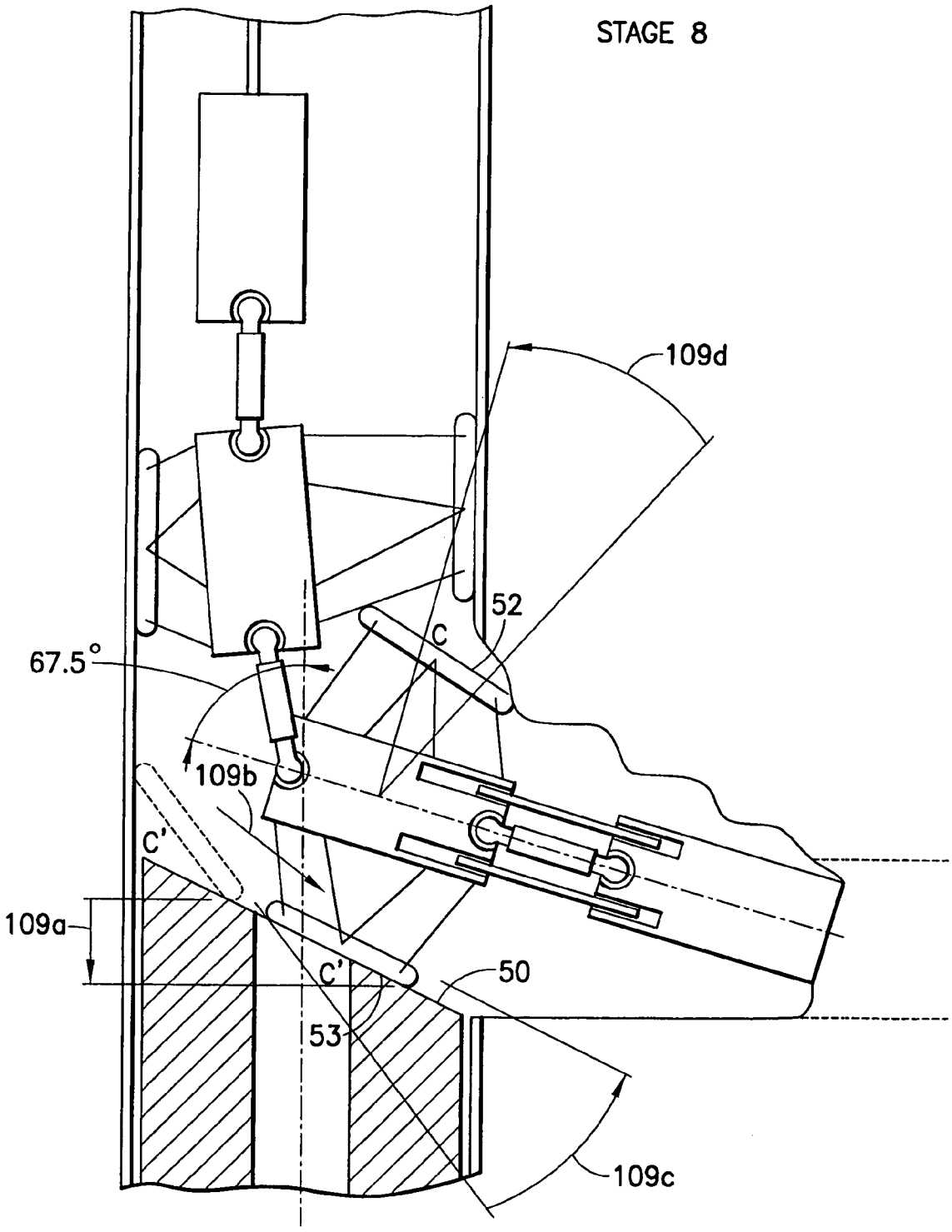
FIG. 29 is a schematic view of modules 41, 51 and 61 of the drill train near the completion of stage 9.

In Stage 9, referring to FIG. 29, the second thrust module drives the assembly of first thrust module and drill module in forward motion so that the driven end moves closer to the whipstock in a forward vertical motion defined by arrow 109*a*. This forward vertical motion drives traction tread 53 in an actual motion indicated by arrow 109*b*. The operator adjusts second six-bar mechanism 54 of first thrust module 51 to pivot traction tread 53 to conform to the local wall. Traction tread 53 pivots in the arc defined by arrow 109*c*. Additionally, the two six-bar mechanisms are driven to tilt the assembly of first thrust module and drill module for pivotal drilling as defined by arrow 109*d*. The combination of these motions moves the assembly of first thrust module and drill module into closer alignment with the axis of the planned branch borehole. This involves a change of tilt $\Delta\theta$ of approximately 22.5° resulting in a tilt angle $\overline{\Delta\theta}$ of approximately 67.5°. (The third pivotal drilling of stage 9 is not shown completed in FIG. 29).

Stage 10: Forward Drilling, Straightening Drill Train

The third pivotal drilling of stage 9, when it is completed, completes the 90° turn of the drill module. The stages contributing to the full 90° are listed in Table 1, under "Change of Tilt Δθ". Stage 2, 1st Setting Module Tilt, contributes 2.5°. Stage 3, First Pivotal Drilling, contributes 20.0°. Stage 6, 2nd Pivotal Drilling, contributes 45°. Stage 9, 3rd Pivotal Drilling, contributes 22.5°. After the drilling module is aligned within the planned borehole, the first and second thrust modules and the cuttings removal module are steered in turn through the alignment process in stage 10.

"Forward Drilling" in stage 10 (not illustrated) includes a series of steps wherein the second thrust module traverses the whipstock with steps "forward drilling, tilting tread 62" and "forward drilling, tilting tread 63" (not shown, but similar to "forward drilling, tilting tread 52" and "forward drilling, tilting tread 53"). The cuttings removal module is pulled through the step-cut region of the branch borehole into the elongated straight portion until all modules are in the elongated straight portion.

The first thrust module is locked in rigid straight-line alignment with the first thrust module through the whole drilling process. The second thrust module and the cuttings removal module are each locked in straight-line alignment with the module they follow as soon as they have completed their transit of the curved step-cut region of the borehole.

Stage 11: Continuous Forward Drilling

The four modules 41, 51, 61 and 71 of the drill train are now in configuration for continuous forward drilling. During continuous forward drilling in the branch borehole, all stiffeners are inserted and the drill train is centered in the branch borehole, i.e. eccentricity and tilt are both zero. Minor adjustments in directional orientation can be effected using the tilt capability of the thrust modules. The four modules of the drill train in continuous forward drilling mode are illustrated in FIG. 1.

The foregoing descriptions of preferred and alternate embodiments of the present invention have been presented for purposes of illustration and description. They are not intended to be exhaustive or to limit the invention to the precise examples described. Many modifications and variations will be apparent to those skilled in the art. The described embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the accompanying claims and their equivalents.

What is claimed is:

1. An articulated modular drill train for drilling through the wall of an oil well and into earth formation to make a branch borehole at a selected depth, the drill train comprising:

a drill module;

a first self propelled thrust module coupled to the drill module, the first thrust module including at least two extendible thrusters having an articulated multi-bar mechanism associated therewith;

a second self propelled thrust module pivotally coupled to the first thrust module, the second thrust module including at least two extendible thrusters.

2. An articulated modular drill train according to claim 1, further comprising a first articulated linkage linking the first thrust module to the drill module.

3. An articulated modular drill train according to claim 1, further comprising a second articulated linkage linking the second thrust module to the first thrust module.

4. An articulated modular drill train according to claim 3, wherein the second articulated linkage includes a thrust-transmission bar having the ball of a knuckle joint at each end, and at least three retractable stiffener bars.

5. An articulated modular drill train according to claim 4, wherein the second articulated linkage includes three retractable stiffener bars.

6. An articulated modular drill train according to claim 1, wherein each thrust module preferably includes two radially opposed extendible thrusters.

7. An articulated modular drill train according to claim 1, wherein each thrust module includes three radially-arrayed extendible thrusters.

8. An articulated modular drill train according to claim 1, wherein each extendible thruster includes a six-bar mechanism and a traction tread.

9. An articulated modular drill train according to claim 1, wherein each thrust module includes an inch-worm type thruster.

10. An articulated modular drill train according to claim 1, wherein the drilling module and the thrust modules each define a portion of an axial mud-outflow passage.

11. An articulated modular drill train according to claim 1, further comprising a cuttings removal module pivotally coupled to the second thrust module.

12. An articulated modular drill train, according to claim 11, further comprising an elongated flexible hose fluid-coupled to the cuttings removal module.

13. An articulated modular drill train, according to claim 12, wherein the elongated flexible hose is longer than the length of the planned branch borehole.

14. An articulated modular drill train according to claim 1, wherein each thrust module is electric-powered and is adapted to receive electrical power via an electric power cable from a power supply at the well-head.

15. An articulated modular drill train according to claim 1, wherein the drill train is adapted for attachment to the lower end of a wireline.

16. A drill module for use in an articulated modular drill train, comprising:

a drill bit having a forward cutting portion covering a front end of the drill module, a pivotal cutting portion covering the sides of the drill module; and at least one electric drive motor and an anti-rotation device having first and second cam-shaped arms.

17. A method for drilling through the wall of an oil well and into earth formation to make a branch borehole, using an axially-aligned articulated modular drilling train, the drilling train having a drill module, a cuttings removal module, a first self-propelled thrust module with at least two extendible thrusters having six-bar mechanisms, and a second self-propelled thrust module with at least two extendible thrusters, the modules coupled by articulated linkages, the method comprising the steps of:

placing a whipstock at a selected depth within the well corresponding to the desired depth of the planned branch borehole;

attaching the drilling train to a wireline above the well;

lowering the drilling train down the well to a position just above the whipstock;

extending the first and second traction treads into contact with the wall of the oil well;

setting tilt in the first thrust module such that the drill module is oriented within the well to execute a first drilling step for cutting through the wall of the well at an acute angle;

executing a first series of drilling steps to open a sharply-curved step-cut region of branch borehole; and executing a second series of forward drilling steps to open an extended lateral region of branch borehole.

18. A method according to claim 17, further comprising drilling the branch borehole in a planned azimuthal direction by orienting the articulated modular drilling train to an azimuthal direction corresponding to the desired azimuthal direction of the planned branch borehole prior to drilling.

19. A method according to claim 17, wherein extending the thrusters includes adjusting the six-bar mechanisms to achieve a selected extension in each mechanism.

20. A method according to claim 17, further comprising setting eccentricity in both thrust modules such that both thrust modules are positioned close to the wall of the oil well on the side of the planned branch borehole prior to setting tilt in the first thrust module.

21. A method according to claim 17, wherein setting tilt includes adjusting six-bar mechanisms.

22. A method according to claim 17, wherein the first series of drilling steps includes pivotal drilling steps and forward drilling steps.

23. A method according to claim 17, further comprising removing cuttings from the drilling operation via a flexible hose for disposal into base of the well.

* * * * *